US010293455B2

(12) United States Patent
Nabeya et al.

(10) Patent No.: US 10,293,455 B2
(45) Date of Patent: May 21, 2019

(54) POLISHING APPARATUS

(71) Applicant: EBARA CORPORATION, Tokyo (JP)

(72) Inventors: Osamu Nabeya, Tokyo (JP); Tetsuji Togawa, Tokyo (JP); Makoto Fukushima, Tokyo (JP); Hozumi Yasuda, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 12 days.

(21) Appl. No.: 15/150,279

(22) Filed: May 9, 2016

(65) Prior Publication Data

US 2016/0250735 A1 Sep. 1, 2016

Related U.S. Application Data

(62) Division of application No. 14/332,357, filed on Jul. 15, 2014, now abandoned, which is a division of
(Continued)

(30) Foreign Application Priority Data

Nov. 1, 2004 (JP) ..... 2004-318581
Mar. 18, 2005 (JP) ..... 2005-079166
May 18, 2005 (JP) ..... 2005-145566

(51) Int. Cl.
*B24B 37/005* (2012.01)
*B24B 37/10* (2012.01)
(Continued)

(52) U.S. Cl.
CPC ..... *B24B 37/20* (2013.01); *B24B 37/005* (2013.01); *B24B 37/042* (2013.01); *B24B 37/10* (2013.01);
(Continued)

(58) Field of Classification Search
CPC ..... B24B 37/005; B24B 37/042; B24B 37/07; B24B 37/10; B24B 37/105; B24B 37/20;
(Continued)

(56) References Cited

U.S. PATENT DOCUMENTS 5,584,751 A 12/1996 Kobayashi et al.
5,738,574 A 4/1998 Tolles et al.
(Continued)

FOREIGN PATENT DOCUMENTS

EP 0747167 A2 12/1996
EP 0922531 A1 6/1999
(Continued)

OTHER PUBLICATIONS

"Extended European Search Report"; for EP application No. 11008956.2; dated Mar. 5, 2014; 11 pages.
(Continued)

*Primary Examiner* — Eileen P Morgan
(74) *Attorney, Agent, or Firm* — Baker & Hostetler LLP

(57) ABSTRACT

A polishing apparatus has a polishing pad, a top ring for holding a semiconductor wafer, and a vertical movement mechanism operable to move the top ring in a vertical direction. The polishing apparatus also has a distance measuring sensor operable to detect a position of the top ring when a lower surface of the top ring is brought into contact with the polishing pad, and a controller operable to calculate an optimal position of the top ring to polish the semiconductor wafer based on the position detected by the distance measuring sensor. The vertical movement mechanism includes a ball screw mechanism operable to move the top ring to the optimal position.

18 Claims, 29 Drawing Sheets

Related U.S. Application Data application No. 13/304,931, filed on Nov. 28, 2011, now Pat. No. 8,845,396, which is a division of application No. 11/665,648, filed as application No. PCT/JP2005/020334 on Oct. 31, 2005, now Pat. No. 8,083,571.

(51) Int. Cl.

| | |
|---|---|
| ***B24B 37/32*** | (2012.01) |
| ***B24B 47/22*** | (2006.01) |
| ***B24B 49/18*** | (2006.01) |
| ***B24B 37/20*** | (2012.01) |
| ***B24B 37/04*** | (2012.01) |
| ***B24B 37/30*** | (2012.01) |
| ***B24B 49/16*** | (2006.01) |
| ***B24B 49/00*** | (2012.01) |

(52) U.S. Cl.

CPC ..... *B24B 37/105* (2013.01); *B24B 37/30* (2013.01); *B24B 37/32* (2013.01); *B24B 47/22* (2013.01); *B24B 49/00* (2013.01); *B24B 49/16* (2013.01); *B24B 49/18* (2013.01); *B24B 49/183* (2013.01)

(58) Field of Classification Search

CPC ..... B24B 37/30; B24B 37/32; B24B 47/22; B24B 49/00; B24B 49/16; B24B 49/18; B24B 49/183

USPC ..... 451/9, 10, 11, 21

See application file for complete search history.

(56) References Cited

U.S. PATENT DOCUMENTS 5,762,539 A 6/1998 Nakashiba et al.
5,762,544 A 6/1998 Zuniga et al.
5,795,215 A 8/1998 Guthrie et al.
5,803,799 A 9/1998 Volodarsky et al.
5,916,016 A 6/1999 Bothra
5,964,653 A 10/1999 Perlov et al.
5,975,994 A * 11/1999 Sandhu ..... B24B 49/10 451/287
6,012,964 A 1/2000 Arai et al.
6,019,868 A 2/2000 Kimura et al.
6,027,398 A * 2/2000 Numoto ..... B24B 37/30 451/285
6,033,292 A 3/2000 Inaba
6,056,632 A 5/2000 Mitchel et al.
6,068,549 A 5/2000 Jackson
6,077,385 A 6/2000 Kimura et al.
6,080,040 A 6/2000 Appel et al.
6,106,378 A 8/2000 Perlov et al.
6,110,025 A 8/2000 Williams et al.
6,113,468 A * 9/2000 Natalicio ..... B24B 37/30 451/41
6,210,255 B1 4/2001 Zuniga et al.
6,220,930 B1 4/2001 Lin et al.
6,231,428 B1 5/2001 Maloney et al.
6,241,585 B1 6/2001 White
6,241,593 B1 6/2001 Chen et al.
6,257,953 B1 * 7/2001 Gitis ..... B24B 37/013 451/287
6,354,907 B1 3/2002 Satoh et al.
6,354,928 B1 3/2002 Crevasse et al.
6,368,189 B1 4/2002 Maloney et al.
6,390,908 B1 5/2002 Chen et al.
6,431,953 B1 * 8/2002 Carter ..... B24B 37/013 451/10
6,435,949 B1 8/2002 Katsuoka et al.
6,494,765 B2 * 12/2002 Gitis ..... B24B 37/013 451/287
6,705,930 B2 3/2004 Boyd et al.
6,857,945 B1 2/2005 Chen et al.
6,872,130 B1 3/2005 Zuniga
7,326,103 B2 * 2/2008 Sakurai ..... B24B 37/30 156/345.13
7,677,958 B2 3/2010 Marohl et al.
7,699,688 B2 4/2010 Zuniga et al.
8,021,215 B2 9/2011 Zuniga et al.
RE44,491 E * 9/2013 Shendon ..... B24B 37/30 451/288
9,358,662 B2 * 6/2016 Miyazaki ..... B24B 37/345
2002/0042246 A1 4/2002 Togawa et al.
2002/0061720 A1 5/2002 Zuniga
2002/0077051 A1 6/2002 Keller
2002/0086624 A1 7/2002 Zuniga et al.
2002/0173242 A1 11/2002 Wang et al.
2003/0092261 A1 5/2003 Kondo et al.
2003/0148718 A1 8/2003 Yun et al.
2004/0092217 A1 * 5/2004 Marquardt ..... B24B 37/32 451/288
2004/0121704 A1 * 6/2004 Sakurai ..... B24B 47/22 451/5
2004/0180610 A1 * 9/2004 Togawa ..... B24B 37/30 451/41
2004/0192168 A1 * 9/2004 Faustmann ..... B24B 49/02 451/5
2004/0214509 A1 * 10/2004 Elledge ..... B24B 37/30 451/11
2005/0215182 A1 9/2005 Fuhriman et al.
2006/0193992 A1 * 8/2006 Bonkass ..... C25D 21/12 427/430.1
2007/0087663 A1 4/2007 Hayama et al.
2007/0232193 A1 * 10/2007 Yasuda ..... B24B 37/32 451/5
2008/0070479 A1 * 3/2008 Nabeya ..... B24B 37/30 451/8
2008/0119120 A1 5/2008 Zuniga et al.
2008/0146123 A1 * 6/2008 Torii ..... B24B 37/32 451/64
2008/0287043 A1 * 11/2008 Saito ..... B24B 49/14 451/285
2009/0305612 A1 * 12/2009 Miyazaki ..... B24B 37/345 451/11
2011/0159783 A1 * 6/2011 Fukushima ..... B24B 37/042 451/11
2015/0273659 A1 10/2015 Aono et al.

FOREIGN PATENT DOCUMENTS

EP 1034887 A2 9/2000
EP 1065030 A2 1/2001
EP 1092505 A2 4/2001
EP 1177859 A2 2/2002
GB 2338439 A 12/1999
JP 62-048462 A 3/1987
JP 05-277929 A 10/1993
JP 05-309559 A 11/1993
JP 09-019863 A 1/1997
JP 09-168968 A 6/1997
JP 09-168969 A 6/1997
JP 2000-288928 A 10/2000
JP 2000-317825 A 11/2000
JP 2001-054854 A 2/2001
JP 2001-096456 A 4/2001
JP 2001-179605 A 7/2001
JP 2001-334461 A 12/2001
JP 2002-113653 A 4/2002
JP 2003-071712 A 3/2003
JP 2003-289057 A 10/2003
JP 2004-042174 A 2/2004
JP 2004-154874 A 6/2004
JP 2004-526585 A 9/2004
JP 2001-319903 A 11/2011
WO WO 1999/007516 A1 2/1999
WO WO 2001/012385 A1 2/2001

(56) References Cited

FOREIGN PATENT DOCUMENTS

| | | | |
|---|---|---|---|
| WO | WO 2002/096601 | A1 | 12/2002 |
| WO | WO 2004/041479 | A1 | 5/2004 |

OTHER PUBLICATIONS

"International Preliminary Report on Patentability"; for International application No. PCT/JP2005/020334; dated Feb. 7, 2006; 5 pages.
"International Search Report"; for International application No. PCT/JP2005/020334; dated Feb. 7, 2006; 2 pages.
"Partial European Search Report"; for EP application No. 11008956.2; dated Nov. 15, 2013; 7 pages.
"Partial European Search Report"; for EP application No. 13005022.2; dated Nov. 20, 2013; 6 pages.
"Supplementary European Search Report"; for EP application No. 05800303.9; dated Feb. 11, 2011; 9 pages.
U.S. Appl. No. 14/312,641; Non-Final Office Action; dated Sep. 15, 2016; 16 pages.

* cited by examiner

POLISHING APPARATUS

CROSS REFERENCE TO RELATED APPLICATIONS

This application is a divisional of U.S. patent application Ser. No. 14/332,357, filed Jul. 15, 2014, which is a divisional of U.S. patent application Ser. No. 13/304,931, filed Nov. 28, 2011, now U.S. Pat. No. 8,845,396, issued Sep. 30, 2014 which is a divisional of U.S. patent application Ser. No. 11/665,648, filed Apr. 18, 2007, now U.S. Pat. No. 8,083,571, issued Dec. 27, 2011, which application is a National Stage of International Application No. PCT/JP2005/020334, filed Oct. 31, 2005, which claims the benefits of Japanese Patent Application No. 2004-318581, filed Nov. 1, 2004, Japanese Patent Application No. 2005-079166, filed Mar. 18, 2005, and Japanese Patent Application No. 2005-145566, filed May 18, 2005, the disclosures of which are incorporated herein by reference in their entireties.

TECHNICAL FIELD

The present invention relates to a polishing apparatus, and more particularly to a polishing apparatus for polishing a substrate such as a semiconductor wafer to a flat mirror finish.

BACKGROUND ART

In recent years, semiconductor devices have become more integrated, and structures of semiconductor elements have become more complicated. Further, the number of layers in multilayer interconnections used for a logical system has been increased. Accordingly, irregularities on a surface of a semiconductor device are increased, so that step heights on the surface of the semiconductor device tend to be large. This is because, in a manufacturing process of a semiconductor device, a thin film is formed on a semiconductor device, then micromachining processes, such as patterning or forming holes, are performed on the semiconductor device, and these processes are repeated to form subsequent thin films on the semiconductor device.

When the number of irregularities is increased on a surface of a semiconductor device, the following problems arise. When a thin film is formed on a semiconductor device, the thickness of the film formed at portions having a step becomes relatively small. Further, an open circuit may be caused by disconnection, or a short circuit may be caused by insufficient insulation between interconnection layers. As a result, good products cannot be obtained, and the yield tends to be lowered. Further, even if a semiconductor device initially works normally, reliability of the semiconductor device is lowered after a long-term use. At the time of exposure in a lithography process, if the irradiation surface has irregularities, then a lens unit in an exposure system is locally unfocused. Therefore, if the irregularities on the surface of the semiconductor device are increased, then it becomes problematically difficult to form a fine pattern itself on the semiconductor device.

Further, as semiconductor devices have become more highly integrated in recent years, circuit interconnections have become finer and distances between those circuit interconnections have become smaller. In the case of photolithography, which can form interconnections that are at most 0.5 μm wide, it is required that surfaces on which pattern images are to be focused by a stepper should be as flat as possible because the depth of focus of an optical system is relatively small.

Thus, in a manufacturing process of a semiconductor device, it increasingly becomes important to planarize a surface of the semiconductor device. One of the most important planarizing technologies is chemical mechanical polishing (CMP). Thus, there has been employed a chemical mechanical polishing apparatus for planarizing a surface of a semiconductor wafer. In a chemical mechanical polishing apparatus, while a polishing liquid containing abrasive particles such as silica ($SiO_2$) therein is supplied onto a polishing surface such as a polishing pad, a substrate such as a semiconductor wafer is brought into sliding contact with the polishing surface, so that the substrate is polished.

This type of polishing apparatus includes a polishing table having a polishing surface formed by a polishing pad, and a substrate holding device, which is referred to as a top ring (substrate holding device), for holding a substrate such as a semiconductor wafer. When a semiconductor wafer is polished with such a polishing apparatus, the semiconductor wafer is held and pressed against the polishing table under a predetermined pressure by the top ring. At that time, the polishing table and the top ring are moved relative to each other to bring the semiconductor wafer into sliding contact with the polishing surface, so that the surface of the semiconductor wafer is polished to a flat mirror finish.

In such a polishing apparatus, the polishing pad is so elastic that pressing forces applied to a peripheral edge portion of the semiconductor wafer tend to be non-uniform. Accordingly, the semiconductor wafer may excessively be polished at the peripheral edge portion to thus cause edge rounding. In order to prevent such edge rounding, there has been employed a top ring having a retainer ring for holding a side edge portion of a semiconductor wafer and pressing a polishing surface located outside of a peripheral edge portion of the semiconductor wafer.

Further, when a polishing apparatus employs a polishing pad made of resin, the polishing pad is worn out by dressing and polishing. In this case, in order to prevent surface pressure distribution from varying on a surface of a semiconductor wafer held by a top ring, a constant distance should be maintained between a surface of the top ring to hold the semiconductor wafer and the polishing pad during polishing. When a retainer ring, which holds a peripheral edge portion of a semiconductor wafer, is provided, the retainer ring may be worn out according to progress of polishing. When the retainer ring is thus worn out, a constant distance should also be maintained between a surface of the top ring to hold the semiconductor wafer and the polishing pad during polishing.

In order to determine whether a polishing process is performed normally in the aforementioned polishing apparatus, it is necessary to monitor a pressing force to press a semiconductor wafer, and concentration and flow rate of a polishing liquid. However, for example, various devices such as a component analyzer and a particle size distribution measuring device are required to monitor a polishing liquid. Accordingly, cost of the polishing apparatus is increased. Further, a polishing profile may also be changed by wear of the polishing pad and the retainer ring. Thus, monitoring only a pressing force and a polishing liquid is insufficient to guarantee that a polishing process is normally performed.

Further, a conventional retainer ring is configured to press a polishing surface uniformly along its overall length in a circumferential direction of the retainer ring. However, as described above, since a polishing pad used to provide a polishing surface is elastic, the polishing pad is elastically deformed so as to produce extremely increased resistance at an outermost portion of the retainer ring which is located upstream along a direction of rotation of the polishing table. Accordingly, the retainer ring is pressed downstream along the direction of rotation of the polishing table so as to cause inclination of the retainer ring. In a conventional polishing apparatus, when the retainer ring is thus inclined, a pressure under which the retainer ring presses the polishing surface is increased to prevent the semiconductor wafer from being separated from the top ring. Further, non-uniformity of the polishing profile which is caused by the inclination of the retainer ring is improved with equalization by rotation of the semiconductor wafer.

However, the conventional retainer ring has difficulty in enhancing the controllability of the temperature of the polishing pad and the polishing profile Accordingly, in order to further enhance the controllability of the temperature of the polishing pad and the polishing profile, it is required to control a pressure under which the retainer ring presses the polishing surface along a circumferential direction of the retainer ring.

SUMMARY OF THE INVENTION

The present invention has been made in view of the above drawbacks. It is, therefore, a first object of the present invention to provide a polishing apparatus which can polish a substrate while a constant distance can be maintained between the substrate and a polishing surface even if the polishing surface or a retainer ring for holding a peripheral portion of the substrate is worn out.

A second object of the present invention is to provide a polishing apparatus in which an elastic membrane attached to a top ring can readily be replaced.

A third object of the present invention is to provide a polishing apparatus which can readily and inexpensively determine whether polishing is normally conducted.

A fourth object of the present invention is to provide a polishing apparatus capable of controlling a pressure under which a retainer ring presses a polishing surface along a circumferential direction of the retainer ring.

According to a first aspect of the present invention, there is provided a polishing apparatus which can polish a substrate while a constant distance can be maintained between the substrate and a polishing surface even if the polishing surface or a retainer ring for holding a peripheral portion of the substrate is worn out. The polishing apparatus has a polishing surface, a top ring for holding a substrate, a vertical movement mechanism operable to move the top ring in a vertical direction, a position detector operable to detect a position of the top ring when a lower surface of the top ring or a lower surface of the substrate held by the top ring is brought into contact with the polishing surface, and a position calculator operable to calculate an optimal position of the top ring to polish the substrate based on the position detected by the position detector. The vertical movement mechanism includes a movement mechanism operable to move the top ring to the optimal position calculated by the position calculator.

With the above arrangement, even if the polishing surface is worn out due to polishing, a constant distance can be maintained between the top ring and the polishing surface during polishing. Accordingly, a surface pressure of the substrate held by the top ring can be made uniform. Further, with the movement mechanism, the top ring can be moved accurately to an optimal position calculated by a pad search process which will be described later. Accordingly, a substrate can be polished in a state such that a constant distance is maintained between the top ring and the polishing surface.

The position detector may include a distance measuring sensor for detecting the position of the top ring. In this case, the polishing apparatus may further comprise a dresser for dressing the polishing surface and a distance measuring sensor for detecting a position of the dresser when the dresser is brought into contact with the polishing surface to obtain a variation of a height of the polishing surface. The vertical movement mechanism may be operable to move the top ring so that the position of the top ring follows the variation of the height of the polishing surface. The distance measuring sensor may be provided on a dresser shaft to measure the amount of wear of the polishing surface (polishing pad) during dressing for each polishing process.

It is desirable that the vertical movement mechanism includes a ball screw for moving the top ring in the vertical direction and a motor for operating the ball screw. In this case, it is also desirable that the motor comprises an AC servomotor. With an AC servomotor, the number of revolutions of the motor can be counted by an encoder to calculate a distance by which the top ring is vertically moved. Accordingly, the position of the top ring can be obtained based on the calculated distance.

It is desirable that the motor has a maximum current such that a torque of the motor during polishing is larger than a torque of the motor when the lower surface of the top ring or the lower surface of the substrate held by the top ring is brought into contact with the polishing surface. The maximum current may be reduced before the lower surface of the top ring or the lower surface of the substrate held by the top ring is brought into contact with the polishing surface.

The position detector may include a current detector operable to detect a current of the motor and determine when the lower surface of the top ring or the lower surface of the substrate held by the top ring is brought into contact with the polishing surface based on a variation of the current of the motor. A dummy wafer may be held as the substrate by the top ring when the position of the top ring is detected by the position detector.

According to a second aspect of the present invention, there is provided a polishing apparatus which can polish a substrate while a constant distance can be maintained between the substrate and a polishing surface even if the polishing surface or a retainer ring for holding a peripheral portion of the substrate is worn out. The polishing apparatus has a polishing surface, a top ring for holding a substrate, a polishing liquid supply nozzle for supplying a polishing liquid to the polishing surface, an ejection nozzle for ejecting a gas toward the polishing surface to remove the polishing liquid from a measurement portion of the polishing surface, and a distance measuring sensor for detecting a position of the polishing surface at the measurement portion.

With the above arrangement, a polishing liquid can be removed from the polishing surface at a measurement portion by ejection of a gas. Laser or ultrasonic wave can be applied to the polishing surface at the measurement portion from the distance measuring sensor. Accordingly, the laser or ultrasonic wave is not reflected on the polishing liquid or water on the polishing surface. Thus, it is possible to accurately detect a distance to the polishing surface. As a result, a constant distance can be maintained between the substrate and the polishing surface based on the measured distance to the surface of the polishing surface.

According to a third aspect of the present invention, there is provided a polishing apparatus which can polish a substrate while a constant distance can be maintained between the substrate and a polishing surface even if the polishing surface or a retainer ring for holding a peripheral portion of the substrate is worn out. The polishing apparatus has a polishing surface and a top ring for holding a substrate. The top ring has a retainer ring for holding a peripheral portion of the substrate. The retainer ring includes a rolling diaphragm having a pressure chamber formed therein, a passage for supplying a fluid to the pressure chamber to vertically expand or contract the rolling diaphragm, and a ring member vertically movable according to the rolling diaphragm. The ring member is brought into contact with the polishing surface.

With the above arrangement, even if the ring member of the retainer ring is worn out, only the retainer ring can be lowered. Accordingly, a constant distance can be maintained between the top ring and the polishing surface even if the ring member of the retainer ring is worn out. Further, since the deformable rolling diaphragm is connected to the ring member, which is brought into contact with the polishing surface, no bending moment is produced by offset loads. Accordingly, surface pressures by the retainer ring can be made uniform, and the retainer ring becomes more likely to follow the polishing surface.

The retainer ring may further include a cylinder housing the rolling diaphragm therein, a holder configured to hold the rolling diaphragm on the cylinder, and a piston vertically movable within the cylinder. The piston is connected to the rolling diaphragm.

According to a fourth aspect of the present invention, there is provided a polishing apparatus in which an elastic membrane attached to a top ring can readily be replaced. The polishing apparatus has a polishing surface, a top ring for holding a substrate, and a top ring shaft movable in a vertical direction. The top ring is connected to the top ring shaft. The top ring includes an upper member connected to the top ring shaft, an elastic membrane which is brought into contact with at least a portion of the substrate, a lower member to which the elastic membrane is attached, and a fastening member configured to detachably fix the lower member to the upper member.

In a conventional top ring, it is necessary to remove the entire top ring from a top ring shaft when an elastic membrane attached to the top ring is replaced. Thus, troublesome processes are required to replace the elastic membrane. According to the present invention, since the lower member to which the elastic membrane is attached can readily be removed from the upper member by detaching the fastening member, it is not necessary to remove the entire top ring from the top ring shaft to replace the elastic membrane.

In this case, the top ring may further include a holder configured to hold the elastic membrane on the lower member. The holder has a hook. The top ring may include a stopper having an engagement portion to engage with the hook of the holder. The stopper may be cylindrical. It is desirable that the engagement portion is formed partially in a circumferential direction of the stopper. It is also desirable that the engagement portion is gradually thickened along the circumferential direction of the stopper. With this arrangement, the elastic membrane can readily be removed from the lower member. Thus, replacement of the elastic membrane is facilitated.

The top ring may further include a retainer ring for holding a peripheral portion of the substrate and a seal member configured to prevent a polishing liquid from being introduced between the retainer ring and the upper member and/or the lower member.

According to the present invention, a substrate can be polished while a constant distance can be maintained between the substrate and a polishing surface even if the polishing surface or a retainer ring for holding a peripheral portion of the substrate is worn out. Further, an elastic membrane attached to a top ring can readily be replaced.

According to a fifth aspect of the present invention, there is provided a polishing apparatus which can readily and inexpensively determine whether polishing is normally conducted. The polishing apparatus has a polishing pad having a polishing surface, a top ring body configured to press a substrate against the polishing surface, and a retainer ring configured to press the polishing surface. The retainer ring is provided at a peripheral portion of the top ring body. The polishing apparatus also has a dresser for dressing the polishing surface, a wear detector for detecting wear of at least one component in the polishing apparatus, and an arithmetical unit operable to calculate an amount of wear of the least one component based on a signal from the wear detector and determine whether polishing is normally conducted based on the amount of wear for a polishing process or a plurality of sets of polishing processes.

According to a sixth aspect of the present invention, there is provided a polishing apparatus having a polishing pad having a polishing surface, a top ring body configured to press a substrate against the polishing surface, and a retainer ring configured to press the polishing surface. The retainer ring is provided at a peripheral portion of the top ring body. The retainer ring includes a rolling diaphragm having a pressure chamber formed therein, a passage for supplying a fluid to the pressure chamber to vertically expand or contract the rolling diaphragm, and a ring member vertically movable according to the rolling diaphragm. The ring member is brought into contact with the polishing surface. The retainer ring also includes a cylinder holding the rolling diaphragm therein and a connection sheet capable of being expanded and contracted in a vertical direction. The connection sheet connects the cylinder and the ring member so as to cover a gap between the cylinder and the ring member.

According to a seventh aspect of the present invention, there is provided a polishing apparatus having a polishing pad having a polishing surface, a top ring body configured to press a substrate against the polishing surface, and a retainer ring configured to press the polishing surface. The retainer ring is provided at a peripheral portion of the top ring body. The polishing apparatus also has an annular sheet member fixed to the top ring body, a plurality of slide rings attached to the annular sheet member, and a plurality of drive pins fixed to the retainer ring. The drive pins are inserted into the slide rings so as to be slidable within the slide rings.

According to an eighth aspect of the present invention, there is provided a polishing apparatus having a polishing pad having a polishing surface, a top ring body configured to press a substrate against the polishing surface, and a retainer ring configured to press the polishing surface. The retainer ring is provided at a peripheral portion of the top ring body. The polishing apparatus also has an elastic membrane provided at a lower portion of the top ring body. The elastic membrane is brought into contact with at least a portion of the substrate. The polishing apparatus includes a seal member covering a gap between the elastic membrane and the retainer ring.

According to a ninth aspect of the present invention, there is provided a polishing apparatus having a polishing pad having a polishing surface, a top ring body configured to press a substrate against the polishing surface, and a retainer ring configured to press the polishing surface. The retainer ring is provided at a peripheral portion of the top ring body. The polishing apparatus also has a pusher operable to receive the substrate from and deliver the substrate to the top ring body and a retainer ring wear detector for detecting wear of the retainer ring. The retainer ring wear detector is provided in the pusher.

According to the present invention, it is possible to determine whether polishing is normally conducted based on the amount of wear of a component. Accordingly, a polishing process can be monitored without any special devices. Thus, based on the determination of the arithmetical unit, it is possible to guarantee that polishing is normally conducted.

Further, the wear detector provided in the pusher can directly measure the amount of wear of the retainer ring to thereby obtain an accurate amount of wear. Accordingly, it is possible to more accurately determine whether polishing is normally conducted.

According to a tenth aspect of the present invention, there is provided a polishing apparatus capable of controlling a pressure under which a retainer ring presses a polishing surface along a circumferential direction of the retainer ring. The polishing apparatus has a polishing surface, a top ring body configured to press a substrate against the polishing surface, and a retainer ring configured to press the polishing surface. The retainer ring is provided at a peripheral portion of the top ring body. The retainer ring includes a pressure control mechanism operable to control a pressure under which the retainer ring presses the polishing surface so as to produce a non-uniform pressure distribution along a circumferential direction of the retainer ring.

The pressure control mechanism may include a ring member which is brought into contact with the polishing surface, a plurality of pressure chambers configured to press the ring member against the polishing surface, and a plurality of passages for supplying fluids independently controlled in pressure to the plurality of pressure chambers. Alternatively, the pressure control mechanism may include a lower ring member having an upper tapered surface and a lower surface which is brought into contact with the polishing surface and an upper ring member having a lower tapered surface which is brought into contact with the upper tapered surface of the lower ring member to convert a radial force applied to the lower ring member into a downward force.

Further, the pressure control mechanism may include a lower ring member having an upper tapered surface and a lower surface which is brought into contact with the polishing surface, an upper ring member having a lower tapered surface which is brought into contact with the upper tapered surface of the lower ring member to convert a radial force applied to the lower ring member into a downward force, at least one pressure chamber configured to press the upper ring member toward the polishing surface, at least one passage for supplying a fluid controlled in pressure to the at least one pressure chambers, and a restriction member which is brought into contact with the upper ring member so as to restrict vertical movement of the upper ring member.

The pressure control mechanism may be operable to control the pressure under which the retainer ring presses the polishing surface according to rotation of the top ring body so as to produce a constant non-uniform pressure distribution in a static system. The pressure control mechanism may be operable to control the pressure under which the retainer ring presses the polishing surface so that a portion located downstream in a rotation direction of the polishing surface is pressed under a pressure higher than a portion located upstream in the rotation direction of the polishing surface.

According to the present invention, the pressure control mechanism can produce a non-uniform pressure distribution along a circumferential direction of the retainer ring. For example, the pressure under which the retainer ring presses the polishing surface can be controlled so that a portion located downstream in a rotation direction of the polishing surface is pressed under a pressure higher than a portion located upstream in the rotation direction of the polishing surface.

The above and other objects, features, and advantages of the present invention will be apparent from the following description when taken in conjunction with the accompanying drawings which illustrate preferred embodiments of the present invention by way of example.

DETAILED DESCRIPTION OF THE INVENTION

Figure 1:
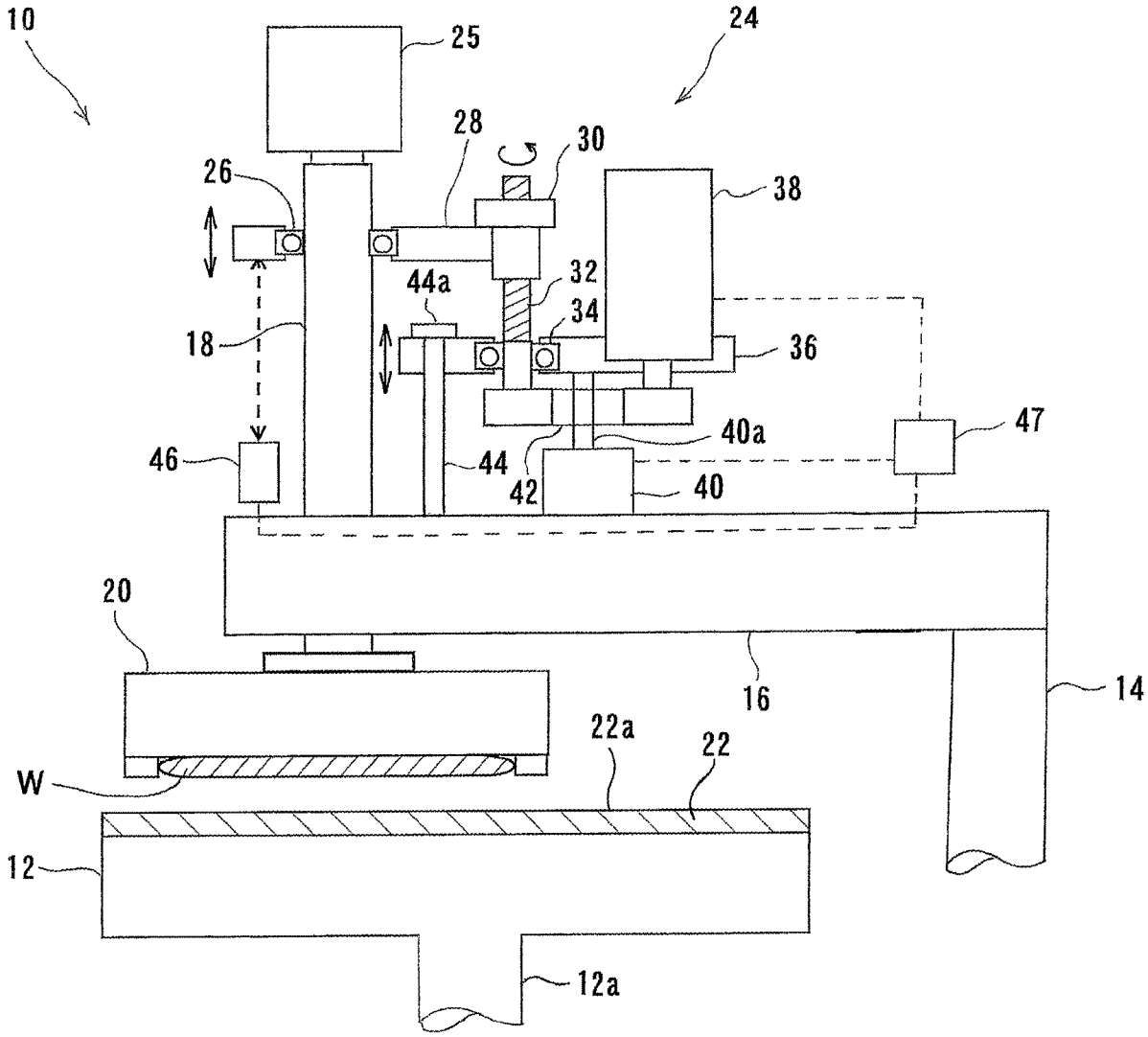
FIG. 1 is a schematic view showing a polishing apparatus according to a first embodiment of the present invention.

Embodiments of a polishing apparatus according to the present invention will be described below with reference to FIGS. 1 through 32. Like or corresponding parts are denoted by like or corresponding reference numerals throughout drawings and will not be described below repetitively.

FIG. 1 is a schematic view showing a polishing apparatus 10 according to a first embodiment of the present invention. As shown in FIG. 1, the polishing apparatus 10 has a polishing table 12, a top ring head 16 connected to an upper end of a support shaft 14, a top ring shaft 18 mounted at a free end of the top ring head 16, and a top ring 20 coupled to a lower end of the top ring shaft 18. In the illustrated example, the top ring 20 is substantially in the form of a circular plate.

The polishing table 12 is coupled via a table shaft 12*a* to a motor (not shown) disposed below the polishing table 12. Thus, the polishing table 12 is rotatable about the table shaft 12*a*. As shown in FIG. 1, a polishing pad 22 is attached to an upper surface of the polishing table 12. An upper surface 22*a* of the polishing pad 22 forms a polishing surface to polish a semiconductor wafer W.

Various kinds of polishing pads are available on the market. For example, some of these are SUBA800, IC-1000, and IC-1000/SUBA400 (two-layer cloth) manufactured by Rodel Inc., and Surfin xxx-5 and Surfin 000 manufactured by Fujimi Inc. SUBA800, Surfin xxx-5, and Surfin 000 are non-woven fabrics bonded by urethane resin, and IC-1000 is made of rigid foam polyurethane (single layer). Foam polyurethane is porous and has a large number of fine recesses or holes formed in its surface.

The top ring shaft 18 is rotated by actuation of a motor (not shown). By rotation of the top ring shaft 18, the top ring 20 is rotated about the top ring shaft 18. Further, the top ring shaft 18 is vertically moved by a vertical movement mechanism 24. By vertical movement of the top ring shaft 18, the top ring 20 is vertically moved with respect to the top ring head 16. A rotary joint 25 is mounted on an upper end of the top ring shaft 18.

The top ring 20 is configured to hold a substrate such as a semiconductor wafer W on its lower surface. The top ring head 16 is pivotable (swingable) about the support shaft 14. Thus, the top ring 20, which holds a semiconductor wafer W on its lower surface, is moved between a position at which the top ring 20 receives the semiconductor wafer W and a position above the polishing table 12 by pivotal movement of the top ring head 16. The top ring 20 is lowered to press the semiconductor wafer W against a surface (polishing surface) 22*a* of the polishing pad 10. At that time, while the top ring 20 and the polishing table 12 are respectively rotated, a polishing liquid is supplied onto the polishing pad 22 from a polishing liquid supply nozzle (not shown), which is provided above the polishing table 12. The semiconductor wafer W is brought into sliding contact with the polishing surface 22*a* on the polishing pad 22. Thus, a surface of the semiconductor wafer W is polished.

The vertical movement mechanism 24, which vertically moves the top ring shaft 18 and the top ring 20, has a first frame 28 supporting the top ring shaft 18 in a manner such that the top ring shaft 18 is rotatable via a bearing 26, a ball screw 32 threaded into a nut 30 mounted on the first frame 28, a second frame 36 supporting the ball screw 32 in a manner such that the ball screw 32 is rotatable via a bearing 34, an AC servomotor 38 provided on the second frame 36, and an air cylinder 40 supporting the second frame 36.

The ball screw 32 is coupled via a belt 42 to the servomotor 38 disposed on the second frame 36. The top ring shaft 18 is configured to be vertically movable together with the first frame 28. Accordingly, when the servomotor 38 is driven, the first frame 28 is vertically moved via the ball screw 32 with respect to the second frame 36. As a result, the top ring shaft 18 and the top ring 20 are vertically moved with respect to the second frame 36.

The air cylinder 40 is disposed on an upper surface of the top ring head 16. The air cylinder 40 has a vertically movable rod 40*a* to support the second frame 36 on its upper end. The ball screw 32 is configured to be vertically movable together with the second frame 36. Accordingly, when the rod 40*a* of the air cylinder 40 is vertically moved, the second frame 36 is vertically moved with respect to the top ring head 16. Further, the ball screw 32 and the first frame 28 are vertically moved with respect to the top ring head 16.

The top ring head 16 has a guide shaft 44 extending upward. The guide shaft 44 is inserted into the second frame 36. When the second frame 36 is vertically moved, the second frame 36 is guided by the guide shaft 44. The guide shaft 44 has a stopper 44*a* at an upper end thereof. Thus, upward movement of the second frame 36 is restricted when an upper surface of the second frame 36 is brought into contact with the stopper 44*a*.

As shown in FIG. 1, the polishing apparatus 10 has a distance measuring sensor 46 serving as a position detector for detecting a distance from the top ring head 16 to a lower surface of the first frame 28, i.e., a position of the first frame 28. The distance measuring sensor 46 detects the position of the first frame 28 so as to detect the position of the top ring 20. Further, the polishing apparatus 10 has a controller 47 operable to control various devices, including the distance measuring sensor 46, the servomotor 38, and the air cylinder 40, in the polishing apparatus 10. The controller 47 includes a storage device and a computer-readable medium having a program recorded therein for controlling the polishing apparatus 10.

When semiconductor wafers W are polished with the polishing apparatus 10 thus constructed, the polishing pad 22 is worn out by dressing and polishing. Accordingly, the thickness of the polishing pad 22 is continuously varied. In this case, in order to prevent surface pressure distribution from varying on a surface of a semiconductor wafer W according to progress of the polishing process, a constant distance should be maintained between the top ring 20 and the surface of the polishing pad 22 during polishing. Thus, in order to maintain a constant distance between the top ring 20 and the surface of the polishing pad 22, it is necessary to detect the height (or position) of the surface of the polishing pad 22 and adjust a position to which the top ring 20 is lowered for each lot of semiconductor wafers (e.g., 25 semiconductor wafers). Such a process to detect the height (or position) of the surface of the polishing pad 22 is referred to as a pad search process.

Figure 2:
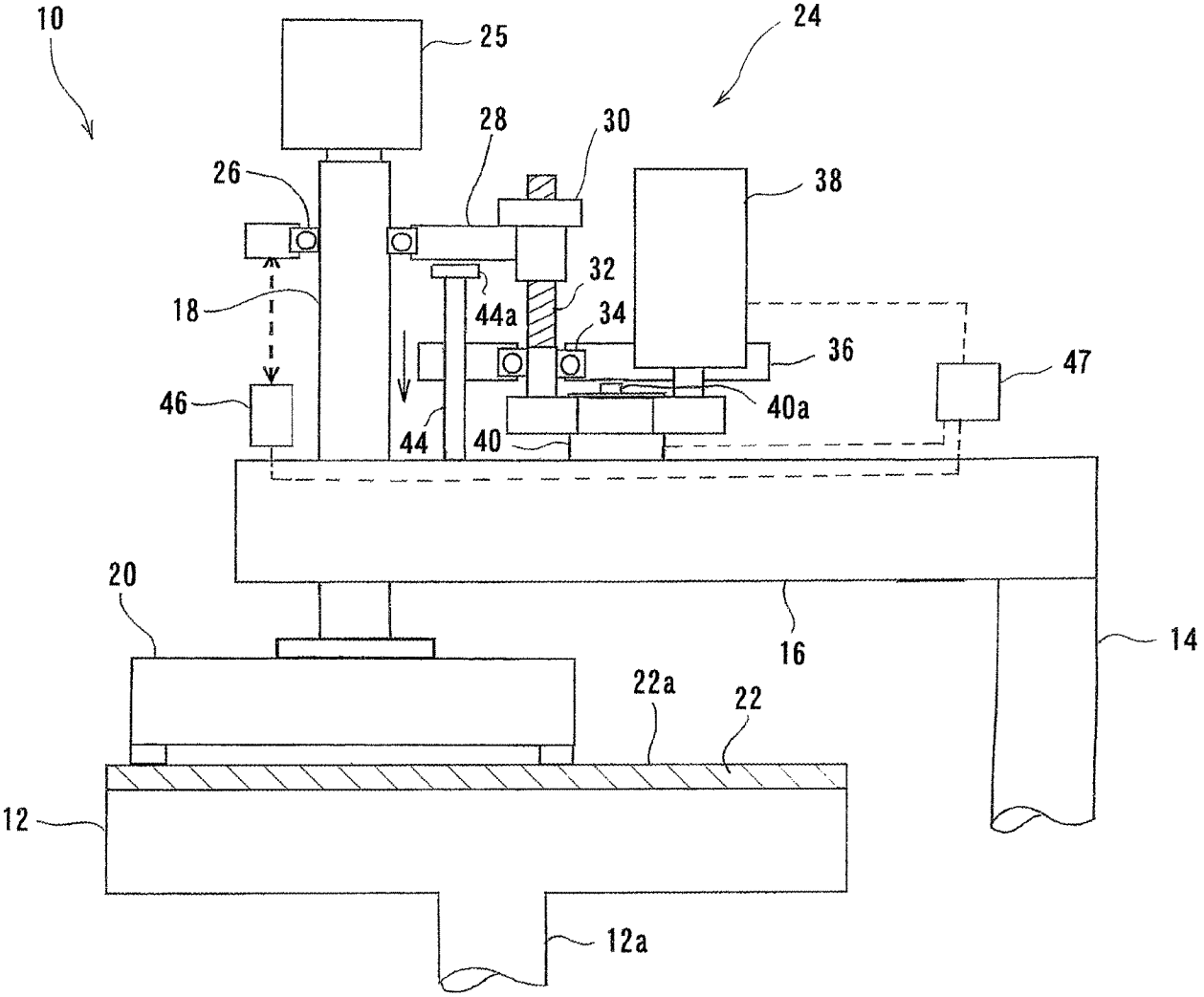
FIG. 2 is a schematic view showing the polishing apparatus shown in FIG. 1 when a pad search process is performed.

In the present embodiment, when the lower surface of the top ring 20 is brought into contact with the polishing surface 22*a* of the polishing pad 22, the position of the top ring 20 is stored in the storage device. The height of the polishing surface 22*a* of the polishing pad 22 is detected based on the stored position of the top ring 20. Specifically, during a pad search process, as shown in FIG. 2, the rod 40*a* of the air cylinder 40 is lowered so that the second frame 36, the ball screw 32, the first frame 28, the top ring shaft 18, and the top ring 20 are lowered due to gravity. Thus, the lowering of the top ring 20 is stopped when the lower surface of the top ring 20 is brought into contact with the surface 22*a* of the polishing pad 22. At that time, the distance measuring sensor 46 detects the position of the first frame 28 to obtain the height of the surface 22*a* of the polishing pad 22 based on the detected position of the first frame 28. The controller 47 operates an arithmetical unit (position calculator) therein so as to calculate an optimal position of the top ring 20 to polish a semiconductor wafer W based on the height of the surface 22*a* of the polishing pad 22. The calculated optimal position of the top ring 20 is stored in the storage device.

Figure 3:
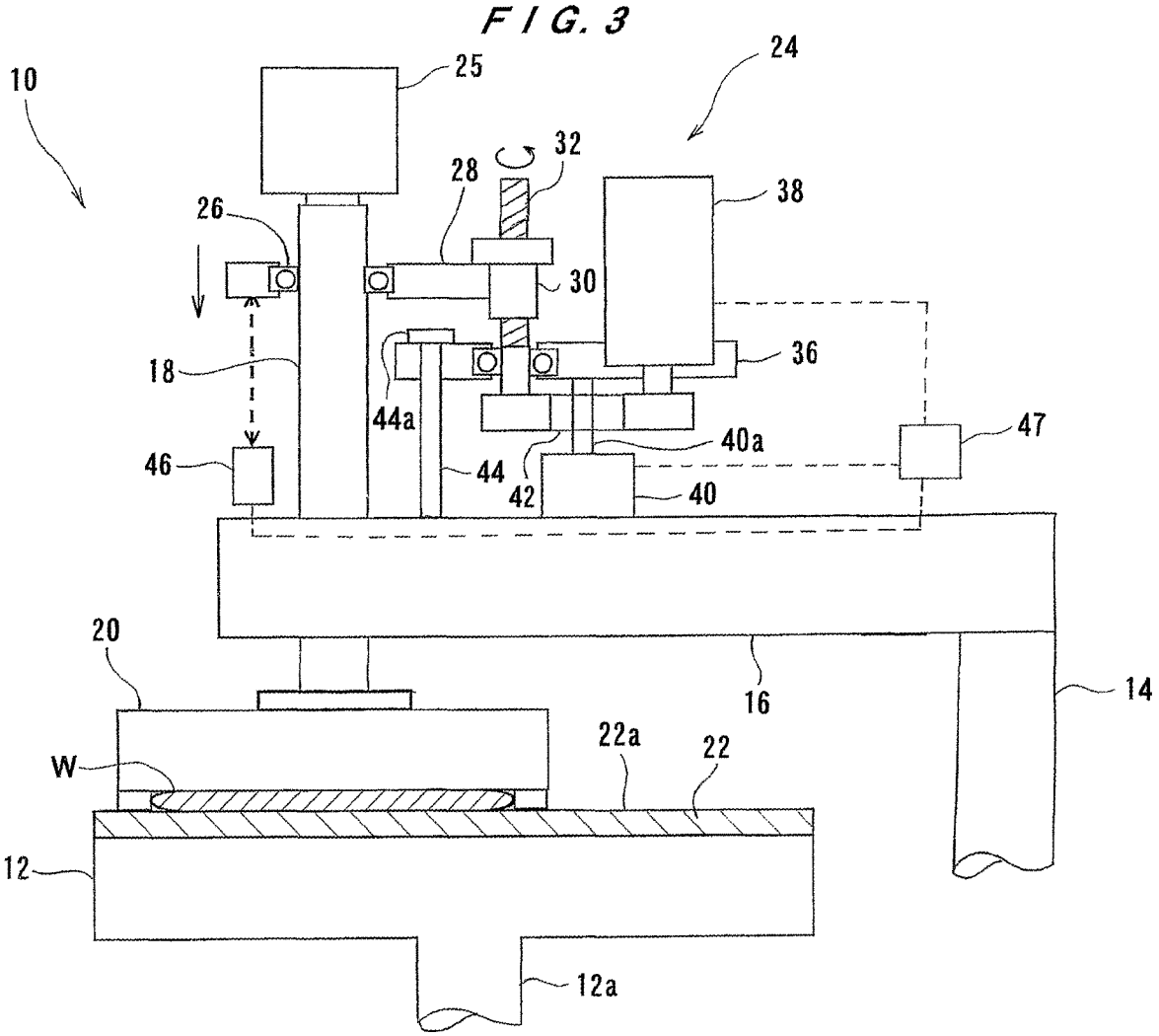
FIG. 3 is a schematic view showing the polishing apparatus shown in FIG. 1 when a semiconductor wafer is polished.

When a semiconductor wafer W is to be polished, the servomotor 38 is driven in a state shown in FIG. 1. Thus, the first frame 28 and the top ring 20 which holds the semiconductor wafer W are lowered as shown in FIG. 3. At that time, the controller 47 controls the servomotor 38 and stops the servomotor 38 when the top ring 20 reaches the calculated optimal position. The semiconductor wafer W held on the lower surface of the top ring 20 is pressed against the polishing pad 22 and polished at the calculated optimal position. In this case, the first frame 28 and the top ring 20 may be lowered while the position of the first frame 28 is detected and confirmed by the distance measuring sensor 46. The distance measuring sensor 46 may comprise any type of sensor including a laser sensor, an ultrasonic sensor, an eddy-current sensor, and a linear scale sensor.

As described above, with a ball screw mechanism having the servomotor 38 and the ball screw 32 in the present embodiment, the top ring 20 can be moved accurately to an optimal position calculated by a pad search process. Accordingly, a semiconductor wafer W can be polished in a state such that a constant distance is maintained between the top ring 20 and the polishing pad 22.

Figure 4:
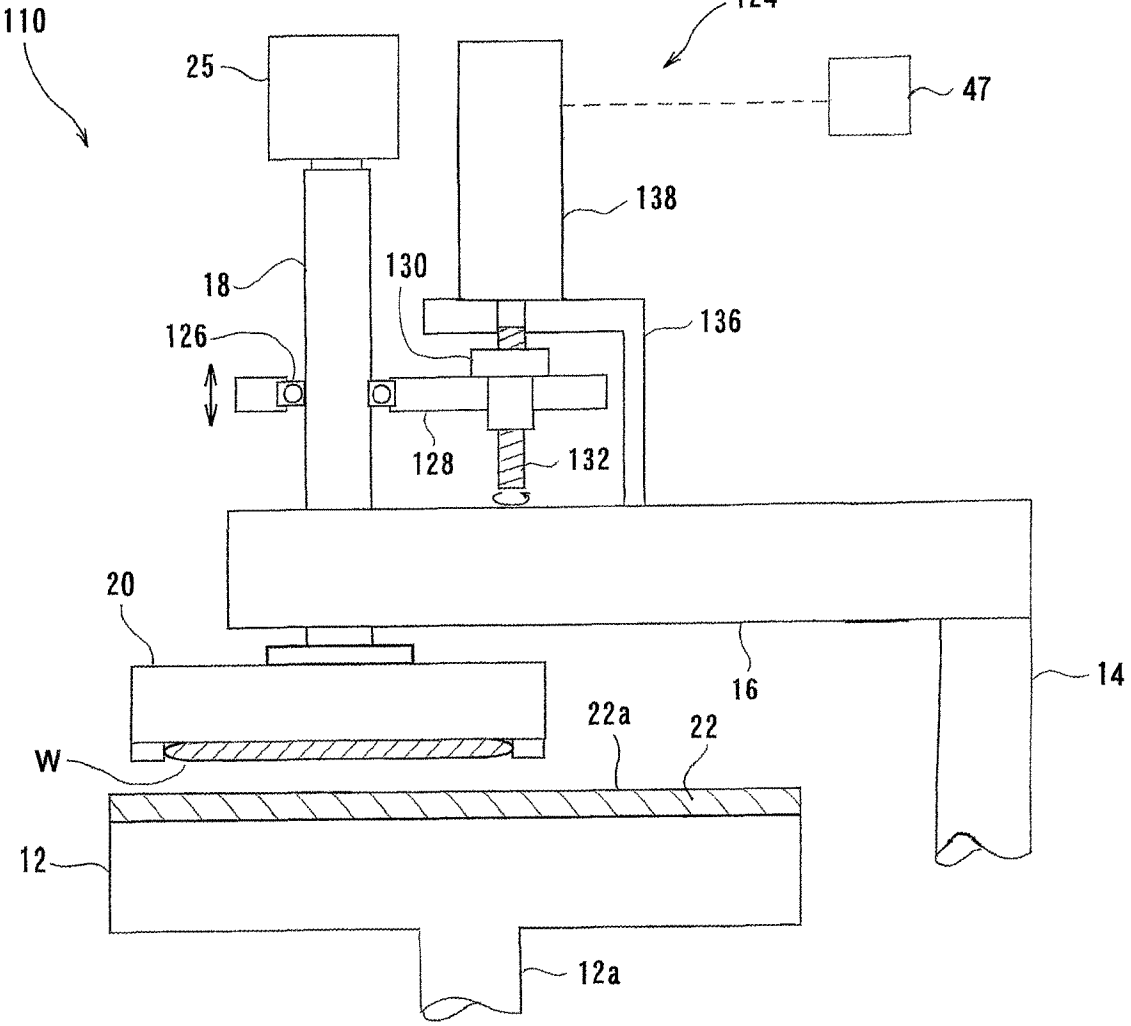
FIG. 4 is a schematic view showing a polishing apparatus according to a second embodiment of the present invention.

FIG. 4 is a schematic view showing a polishing apparatus 110 according to a second embodiment of the present invention. As shown in FIG. 4, in the polishing apparatus 110 of the present embodiment, the top ring shaft 18 is vertically movable with respect to the top ring head 16 by a vertical movement mechanism 124. The vertical movement mechanism 124 has a first frame 128 supporting the top ring shaft 18 in a manner such that the top ring shaft 18 is rotatable via a bearing 126, a ball screw 132 threaded into a nut 130 mounted on the first frame 128, a second frame 136 fixed on the top ring head 16, and an AC servomotor 138 provided on the second frame 136 for rotating the ball screw 132. The controller 47 includes a current detector for detecting a current flowing through the servomotor 138. The controller 47 includes a storage device and a computer-readable medium having a program recorded therein for controlling the polishing apparatus 110.

The top ring shaft 18 is configured to be vertically movable together with the first frame 128. Accordingly, when the servomotor 138 is driven, the first frame 128 is vertically moved via the ball screw 132 with respect to the top ring head 16. As a result, the top ring shaft 18 and the top ring 20 are vertically moved with respect to the top ring head 16.

Figure 5:
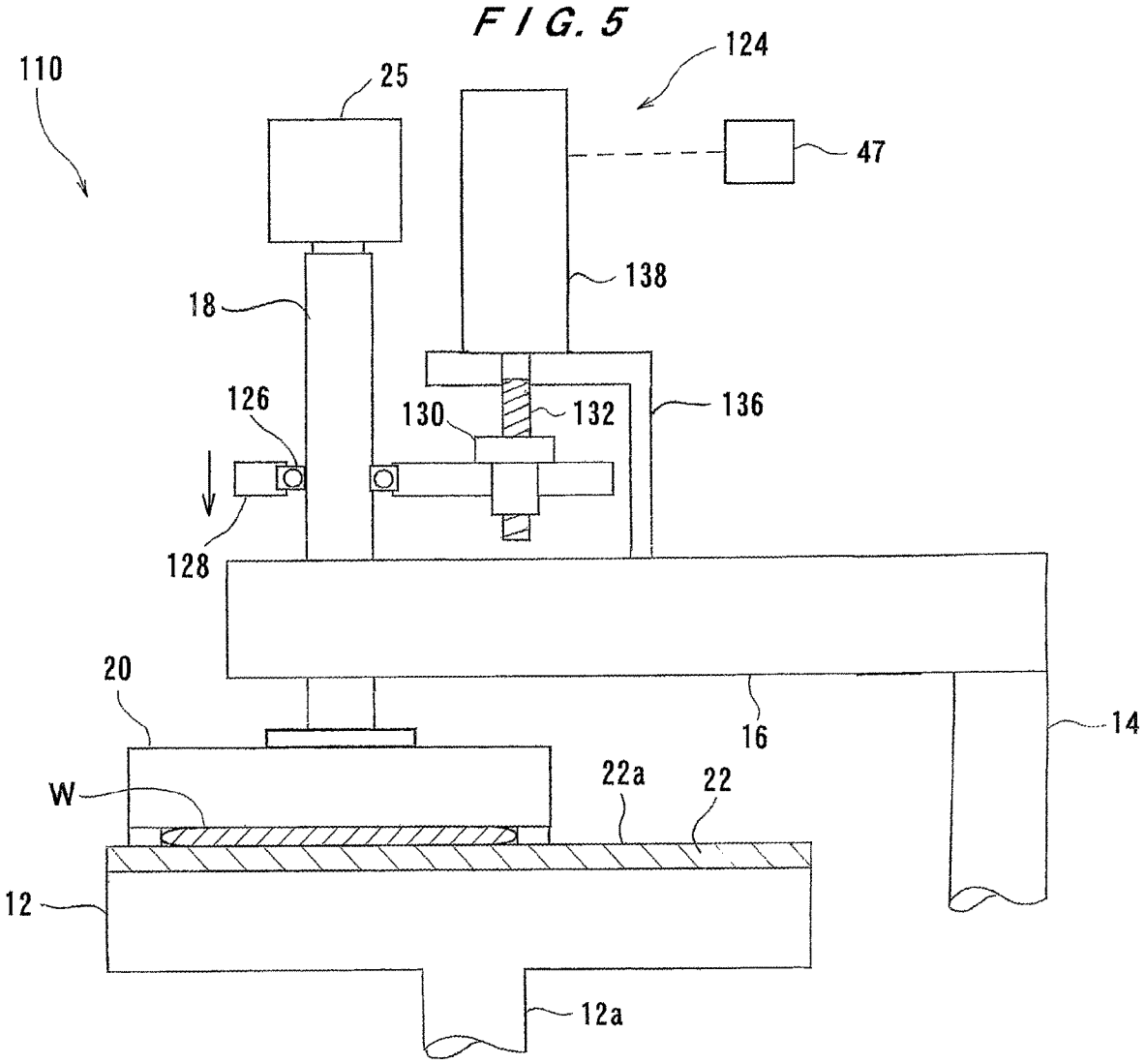
FIG. 5 is a schematic view showing the polishing apparatus shown in FIG. 4 when a pad search process is performed.

In the present embodiment, as with the first embodiment, a pad search process is performed by detecting the position of the top ring 20 when the lower surface of the top ring 20 is brought into contact with the polishing surface 22*a* of the polishing pad 22. The pad search process in the present embodiment is performed without a distance measuring sensor. Specifically, during a pad search process, the servomotor 138 is driven to lower the top ring 20 while the number of revolutions is counted by an encoder. As shown in FIG. 5, when the lower surface of the top ring 20 is brought into contact with the surface 22*a* of the polishing pad 22, loads on the servomotor 138 are increased. Accordingly, a current flowing through the servomotor 138 is also increased. The current detector in the controller 47 detects a current flowing through the servomotor 138 and determines that the lower surface of the top ring 20 is brought into contact with the surface 22*a* of the polishing pad 22 when a large current is detected. After it is determined that the lower surface of the top ring 20 is brought into contact with the surface 22*a* of the polishing pad 22, the controller 47 calculates a distance by which the top ring 20 is lowered based on the counted value of the encoder of the servomotor 138. The distance by which the top ring 20 is lowered is stored in the storage device. The height of the surface 22*a* of the polishing pad 22 is obtained based on the distance by which the top ring 20 is lowered. The controller 47 operates an arithmetical unit (position calculator) so as to calculate an optimal position of the top ring 20 to polish a semiconductor wafer based on the height of the surface 22*a* of the polishing pad 22.

When a semiconductor wafer W is to be polished, the servomotor 138 is driven in a state shown in FIG. 4 so as to lower the first frame 128 and the top ring 20. At that time, the controller 47 controls the servomotor 138 and stops the servomotor 138 when the top ring 20 reaches the calculated optimal position. The semiconductor wafer W held on the lower surface of the top ring 20 is pressed against the polishing pad 22 and polished at the calculated optimal position.

In the present embodiment, the top ring 20 holds a semiconductor wafer W during a pad search process. In the first embodiment, a pad search process may be performed in a state such that the top ring 20 holds a semiconductor wafer W. In either case, it is desirable that a dummy wafer is used rather than a product wafer when a pad search process is performed. When a dummy wafer is used during a pad search process, the lower surface of the top ring 20 is not exposed. Accordingly, components attached to the lower surface of the top ring 20 are prevented from being brought into direct contact with the polishing pad 22. Thus, slurry (polishing liquid) is prevented from being attached to these components.

Further, it is desirable that the servomotor 138 is capable of changing a maximum current of the motor. With such a servomotor, for example, a maximum current of the motor is set to be about 5% during a pad search process. When the lower surface of the top ring 20 or the surface of the semiconductor wafer (dummy wafer) W is brought into contact with the polishing pad 22, extremely large loads are prevented from being imposed on the semiconductor wafer (dummy wafer) W, the top ring 20, the polishing pad 22, or the like. In this case, if it is possible to predict when the top ring 20 is brought into contact with the polishing pad 22 based on a period of time for which the top ring 20 is lowered or on a distance by which the top ring 20 is lowered, then it is desirable that the maximum current of the servomotor 138 is reduced before the top ring 20 is brought into contact with the polishing pad 22. This operation prevents the lower surface of the top ring 20 or the semiconductor wafer W from being damaged.

Figure 6:
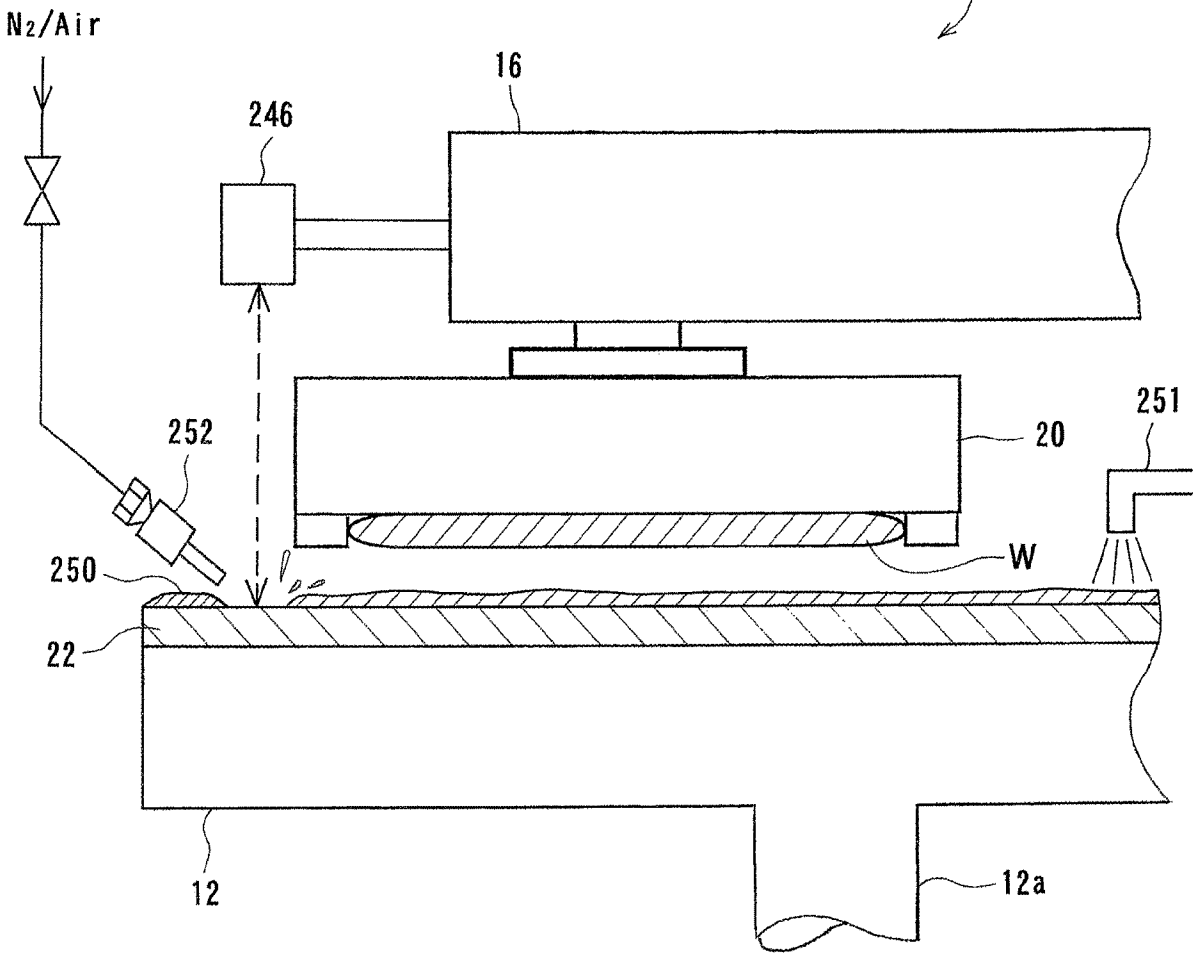
FIG. 6 is a schematic view showing a polishing apparatus according to a third embodiment of the present invention.

FIG. 6 is a schematic view showing a polishing apparatus 210 according to a third embodiment of the present invention. As shown in FIG. 6, the polishing apparatus 210 in the present embodiment has a laser distance measuring sensor 246 for detecting the height of the polishing pad 22, a polishing liquid supply nozzle 251 for supplying slurry (polishing liquid) 250 onto the polishing pad 22, and an ejection nozzle 252 for ejecting nitrogen gas or air toward a surface of the polishing pad 22 to blow off the slurry 250 on the polishing pad 22. The distance measuring sensor 246 may comprise an ultrasonic distance measuring sensor.

With such an arrangement, the slurry 250 is removed from the polishing pad 22 by ejection of nitrogen gas or air. A laser can be applied from the laser distance measuring sensor 246 to a measurement portion from which the slurry 250 is removed. Accordingly, since the laser is not reflected on slurry or water on the polishing pad 22, it is possible to accurately detect a distance to the polishing pad 22. As a result, a constant distance can be maintained between the semiconductor wafer W and the polishing pad 22 based on the measured distance to the surface of the polishing pad 22.

In the above embodiments, a pad search process is performed for each lot of semiconductor wafers by detecting the height (position) of the top ring 20. However, the pad search process is not limited to this example. For example, when a product wafer should not be used for a pad search process, or a dummy wafer cannot be prepared for some reason, then a portion of a pad search process can be performed by a dresser, which dresses (conditions) a polishing surface of a polishing pad.

Figure 7:
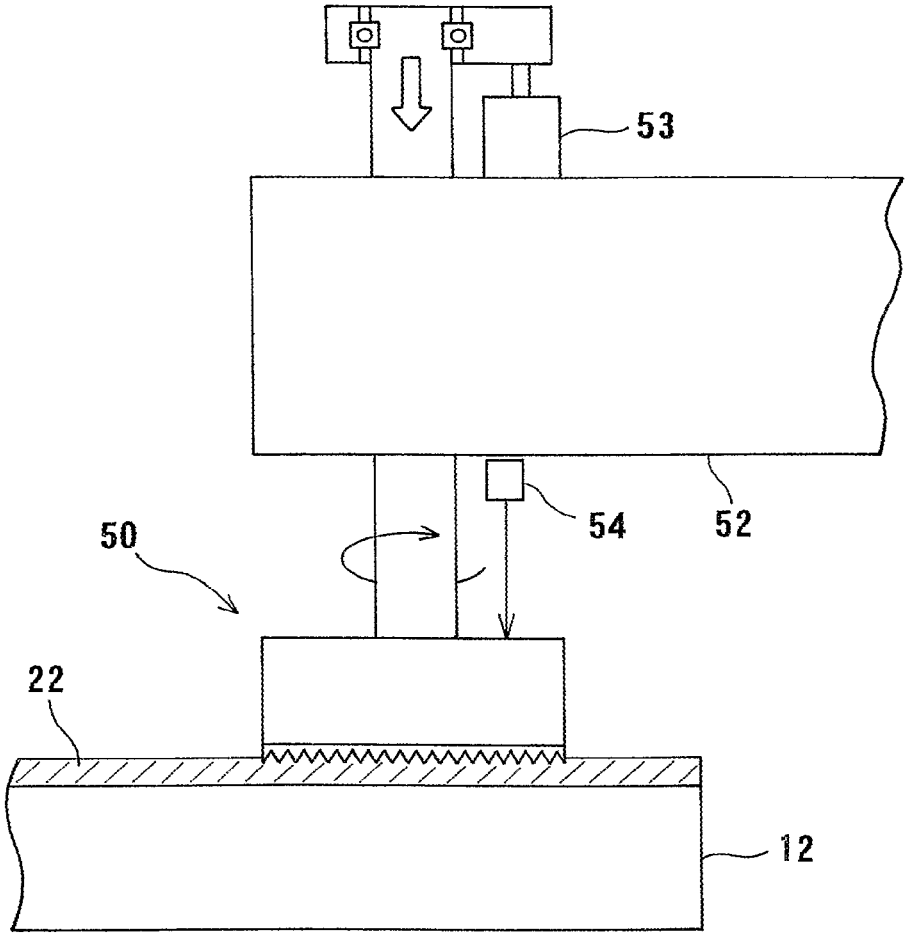
FIG. 7 is a schematic view showing a portion of a polishing apparatus according to a fourth embodiment of the present invention.

FIG. 7 is a schematic view showing a portion of a polishing apparatus according to a fourth embodiment of the present invention. FIG. 7 mainly shows a dresser 50 having a function to perform a pad search process. An air cylinder 53 is attached to a dresser head 52 of the dresser 50. The dresser 50 is pressed against the polishing pad 22 by actuation of the air cylinder 53.

Variation of the thickness of the polishing pad 22 is measured by using the dresser 50. In this case, since polishing pads have different thicknesses, a pad search process is performed by using the top ring 20 when a polishing pad is replaced with a new pad. At that time, components (e.g., elastic membranes) attached to the lower surface of the top ring 20 may be brought into direct contact with the polishing pad 22 without a product wafer or a dummy wafer held by the top ring 20 because the polishing pad that has not been used causes no problems to such components.

The dresser head 52 of the dresser 50 has a distance measuring sensor 54. Variations detected by the distance measuring sensor 54 are used to follow wear of the polishing pad 22 for a polishing process of each semiconductor wafer and for each lot of semiconductor wafers. Specifically, the distance measuring sensor 54 detects a difference between an initial vertical position of the dresser 50 and a measured vertical position of the dresser 50 to determine the amount of wear of the polishing pad 22. The amount of wear of the polishing pad 22 is sent to the controller 47. The total amount of wear of the polishing pad 22 is determined based on results of the pad search process performed with the top ring 20 at the time of replacement of the polishing pad and on the variation of the thickness of the polishing pad 22 which is detected by the dresser 50. The top ring 20 is controlled in height so as to follow the total amount of wear of the polishing pad 22. When variation of the thickness of the polishing pad 22 is thus measured with the dresser 50, a throughput can be increased as compared to a case where a pad search process is performed for each lot of semiconductor wafers (e.g., 25 semiconductor wafers) with the top ring 20.

Figure 8:
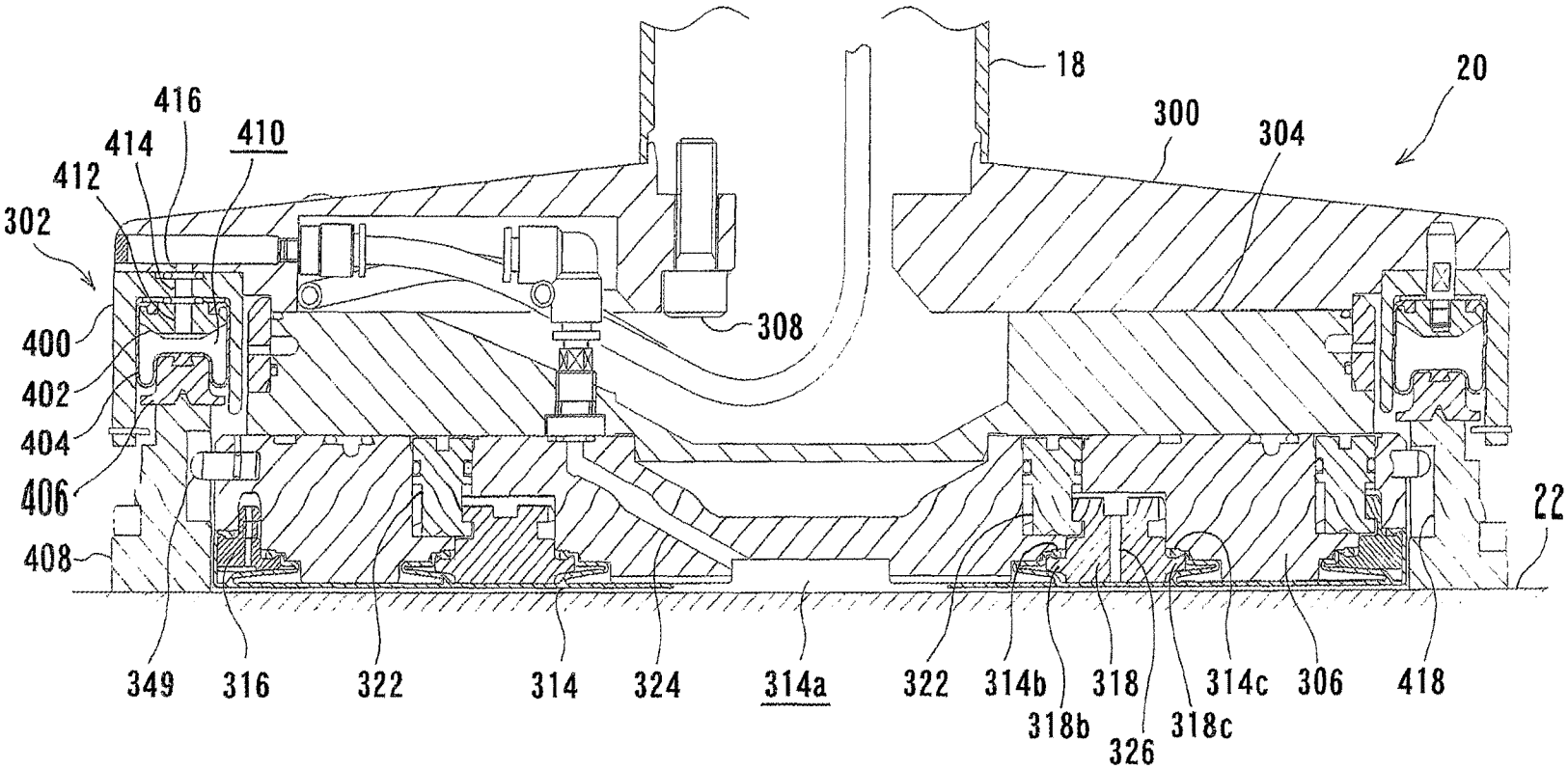
FIG. 8 is a vertical cross-sectional view showing an example of a top ring which is suitably used in the polishing apparatus in the first through fourth embodiments of the present invention.
Figure 9:
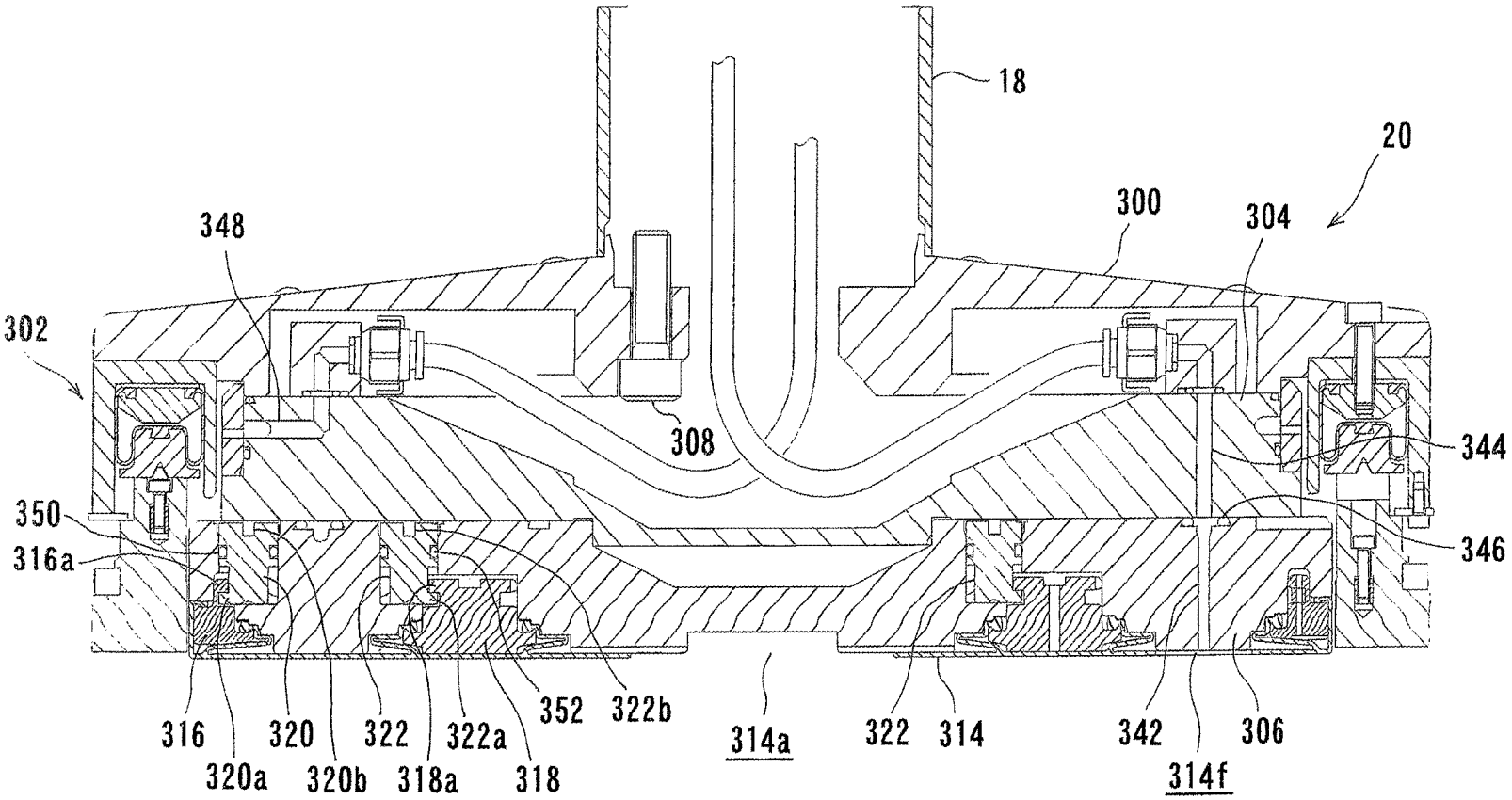
FIGS. 9 and 10 are vertical cross-sectional views of the top ring shown in FIG. 8.
Figure 10:
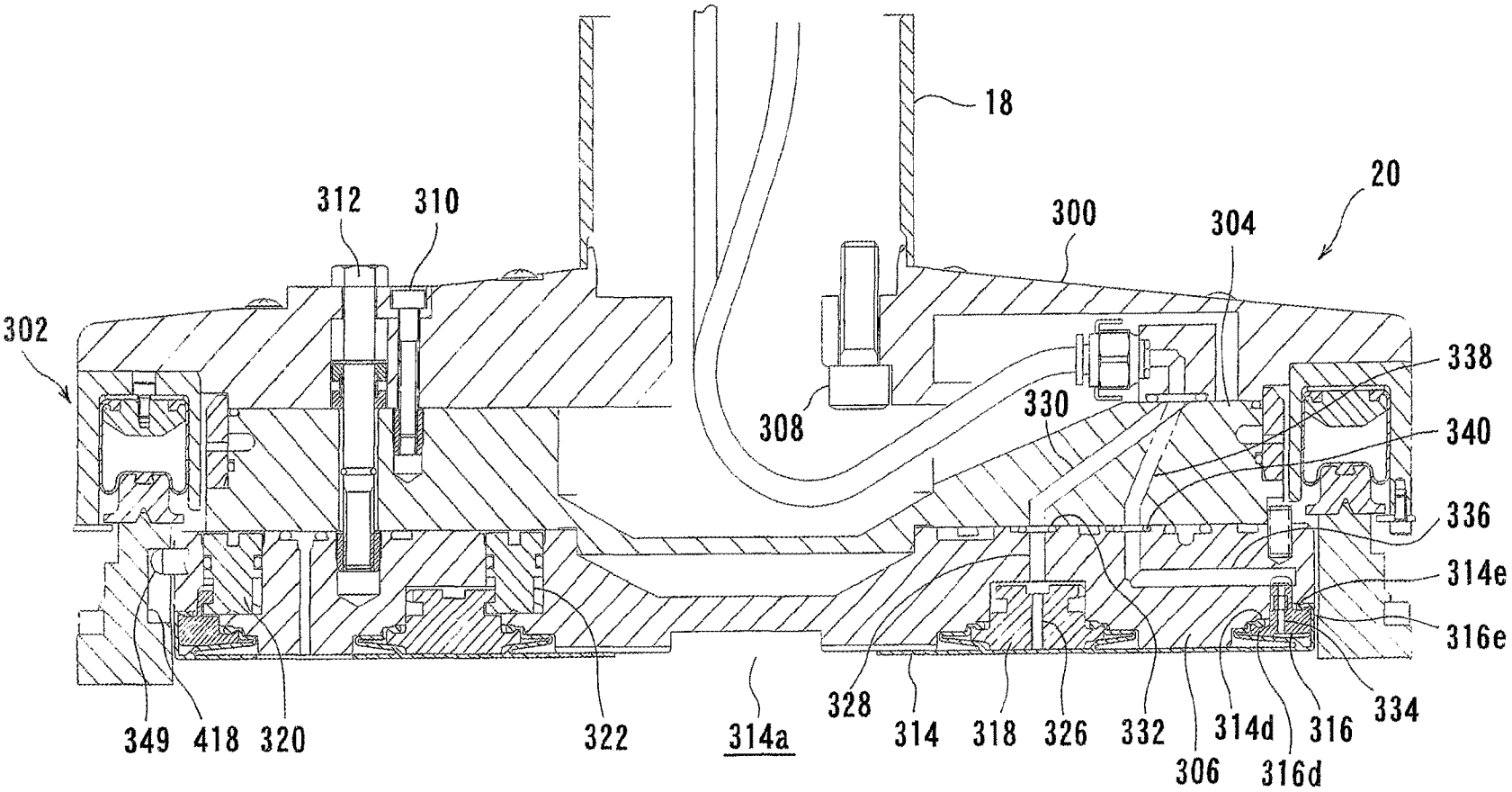

Next, a top ring which is suitably used as the top ring 20 in the first through fourth embodiments will be described below in detail. FIGS. 8 through 10 are cross-sectional views showing an example of the top ring 20 along a plurality of radial directions of the top ring 20.

As shown in FIGS. 8 through 10, the top ring 20 has an upper member 300 in the form of a circular plate, a retainer ring 302 attached to a peripheral portion of the upper member 300, an intermediate member 304 attached to a lower surface of the upper member 300, and a lower member 306 attached to a lower surface of the intermediate member 304. The upper member 300 is connected to the top ring shaft 18 by a bolt 308. Further, as shown in FIG. 10, the intermediate member 304 is fixed to the upper member 300 by a bolt 310 (fastening member), and the lower member 306 is fixed to the upper member 300 by a bolt 312 (fastening member). Such fastening members are not limited to bolts.

The top ring 20 has an elastic membrane 314 attached to a lower surface of the lower member 306. The elastic membrane 314 is brought into contact with a rear face of a semiconductor wafer held by the top ring 20. The elastic membrane 314 is held on the lower surface of the lower member 306 by an edge holder 316 disposed radially outward and an annular ripple holder 318 disposed radially inward of the edge holder 316. The edge holder 316 and the ripple holder 318 are held on the lower surface of the lower member 306 by stoppers 320 and 322, respectively. The elastic membrane 314 is made of a highly strong and durable rubber material such as ethylene propylene rubber (EPDM), polyurethane rubber, silicone rubber, or the like.

The elastic membrane 314 has an opening 314*a* defined at a central portion thereof. As shown in FIG. 8, the lower member 306 has a passage 324 communicating with the opening 314*a*. The passage 324 of the lower member 306 is connected to a fluid supply source (not shown). Thus, a pressurized fluid is supplied through the passage 324 to the central portion of the elastic membrane 314. Further, the passage 324 is selectively connected to a vacuum pump (not shown). When the vacuum pump is operated, a semiconductor wafer is attracted to the lower surface of the lower member 306 by suction.

The ripple holder 318 has claws 318*b* and 318*c* for holding ripples 314*b* and 314*c* of the elastic membrane 314 on the lower surface of the lower member 306. The ripple holder 318 has a passage 326 communicating with a ripple chamber formed by the ripples 314*b* and 314*c* of the elastic membrane 314. As shown in FIG. 10, the lower member 306 has a passage 328 communicating with the passage 326 of the ripple holder 318. The intermediate member 304 has a passage 330 communicating with the passage 328 of the lower member 306. An O-ring 332 is disposed as a seal member at a connecting portion between the passage 328 of the lower member 306 and the passage 330 of the intermediate member 304. The passage 326 of the ripple holder 318 is connected via the passage 328 of the lower member 306 and the passage 330 of the intermediate member 304 to a fluid supply source (not shown). Thus, a pressurized fluid is supplied through the passages 330, 328, and 326 to the ripple chamber of the elastic membrane 314.

As shown in FIG. 10, the edge holder 316 has claws 316*d* and 316*e* for holding edges 314*d* and 314*e* of the elastic membrane 314 on the lower surface of the lower member 306. The edge holder 316 has a passage 334 communicating with an edge chamber formed by the edges 314*d* and 314*e* of the elastic membrane 314. The lower member 306 has a passage 336 communicating with the passage 334 of the edge holder 316. The intermediate member 304 has a passage 338 communicating with the passage 336 of the lower member 306. An O-ring 340 is disposed as a seal member at a connecting portion between the passage 336 of the lower member 306 and the passage 338 of the intermediate member 304. The passage 334 of the edge holder 316 is connected via the passage 336 of the lower member 306 and the passage 338 of the intermediate member 304 to a fluid supply source (not shown). Thus, a pressurized fluid is supplied through the passages 338, 336, and 334 to the edge chamber of the elastic membrane 314.

As shown in FIG. 9, the elastic membrane 314 has openings 314*f* located between the ripple holder 318 and the edge holder 316. The lower member 306 has a passage 342 communicating with the openings 314*f*. The intermediate member 304 has a passage 344 communicating with the passage 342 of the lower member 306. An O-ring 346 is disposed as a seal member at a connecting portion between the passage 342 of the lower member 306 and the passage 344 of the intermediate member 304. The passage 342 of the lower member 306 is connected via the passage 344 of the intermediate member 304 to a fluid supply source (not shown). Thus, a pressurized fluid is supplied through the passages 344 and 342 to an outer portion of the elastic membrane 314. Further, the passage 342 is selectively connected to a vacuum pump (not shown). When the vacuum pump is operated, a semiconductor wafer is attracted to the lower surface of the lower member 306 by suction.

As described above, with the top ring 20 in the present embodiment, pressing forces to press a semiconductor wafer against the polishing pad 22 can be adjusted at local areas of the semiconductor wafer by adjusting pressures of fluids to be supplied to the respective portions of the elastic membrane 314 (i.e., the central portion, the ripple chamber, the outer portion, and the edge chamber of the elastic membrane 314).

The intermediate member 304 has a cleaning liquid passage 348 formed at a peripheral portion thereof. The cleaning liquid passage 348 of the intermediate member 304 is connected to a cleaning liquid supply source (not shown). Thus, a cleaning liquid is supplied through the cleaning liquid passage 348 to a space between the retainer ring 302 and the intermediate member 304.

Figure 11:
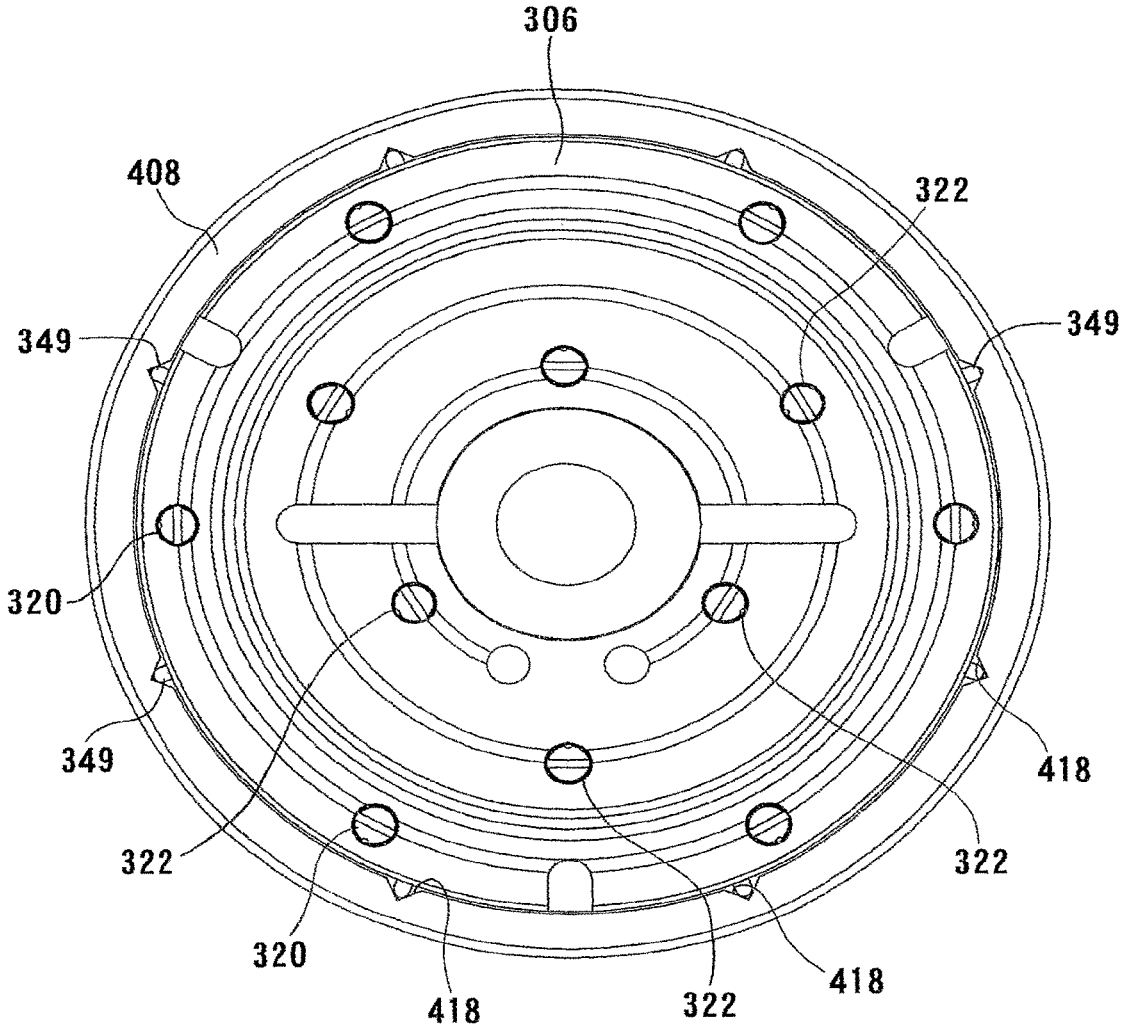
FIG. 11 is a plan view showing a lower member of the top ring shown in FIG. 8.
Figure 12A:
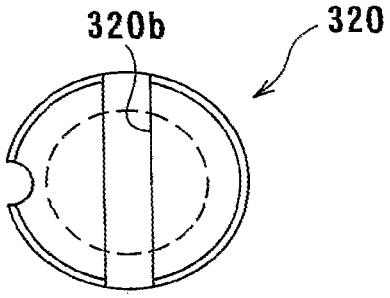
FIG. 12A is a plan view showing a stopper in the top ring shown in FIG. 8.
Figure 12B:
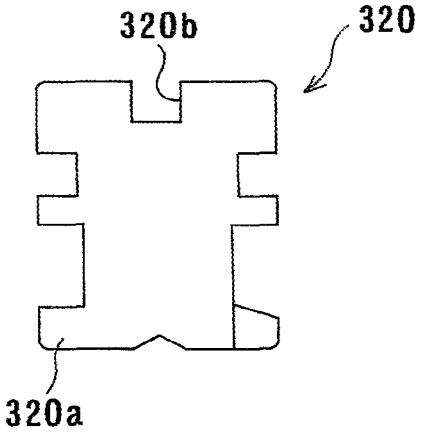
FIG. 12B is a vertical cross-sectional view of the stopper shown in FIG. 12A.
Figure 12C:
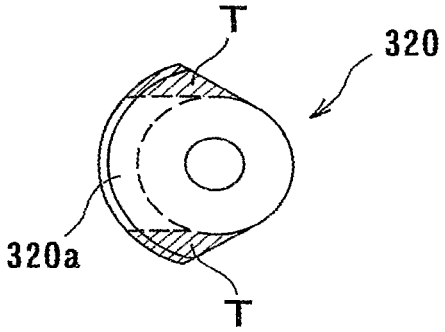
FIG. 12C is a bottom view of the stopper shown in FIG. 12A.

As shown in FIG. 9, the edge holder 316 has hooks 316*a* provided at upper portions thereof. Each of the stoppers 320 for holding the edge holder 316 is cylindrical and has an engagement portion 320*a* provided at a lower end thereof. As shown in FIG. 11, a plurality of stoppers 320 are arranged along a circumferential direction of the top ring 20 at equal intervals. FIGS. 12A through 12C show details of the stopper 320. FIG. 12A is a plan view, FIG. 12B is a vertical cross-sectional view, and FIG. 12C is a bottom view.

As shown in FIG. 12C, the engagement portion 320*a* is formed partially in a circumferential direction of the stopper 320. The engagement portion 320*a* has tapered portions T on opposite sides thereof. Each of the tapered portions T is gradually thickened along the circumferential direction of the stopper 320. Thus, when the stopper 320 is rotated, the engagement portion 320*a* of the stopper 320 is gradually engaged with the hook 316*a* of the edge holder 316. Finally, the hook 316*a* of the edge holder 316 is fixed to the lower member 306 by the engagement portion 320*a* of the stopper 320. The stopper 320 has a groove 320*b* formed on its upper surface so that a rotation tool can be inserted into the groove 320*b* of the stopper 320. Thus, an operator can attach the elastic membrane 314 on and detach the elastic membrane 314 from the lower member 306 with use of the rotation tool above the lower member 306.

Similarly, the ripple holder 318 has hooks 318*a* provided at upper portions thereof. Each of the stoppers 322 for holding the ripple holder 318 is cylindrical and has an engagement portion 322*a* provided at a lower end thereof. The engagement portion 322*a* is formed partially in a circumferential direction of the stopper 322. The engagement portion 322*a* has tapered portions on opposite sides thereof. Each of the tapered portions is gradually thickened along the circumferential direction of the stopper 322. Thus, when the stopper 322 is rotated, the engagement portion 322*a* of the stopper 322 is gradually engaged with the hook 318*a* of the ripple holder 318. Finally, the hook 318*a* of the ripple holder 318 is fixed to the lower member 306 by the engagement portion 322*a* of the stopper 322. The stopper 322 has a groove 322*b* formed on its upper surface so that a rotation tool can be inserted into the groove 322*b* of the stopper 322. Thus, an operator can attach the elastic membrane 314 on and detach the elastic membrane 314 from the lower member 306 with use of the rotation tool above the lower member 306.

O-rings 350 and 352 are attached to the stoppers 320 and 322, respectively. The O-rings 350 and 352 seal pressurized fluids supplied to the edge chamber and the ripple chamber of the elastic membrane 314.

The retainer ring 302 serves to hold a peripheral edge of a semiconductor wafer. As shown in FIG. 8, the retainer ring 302 has a cylinder 400, a holder 402 attached to an upper portion of the cylinder 400, an elastic membrane 404 held in the cylinder 400 by the holder 402, a piston 406 connected to a lower end of the elastic membrane 404, and a ring member 408 which is pressed downward by the piston 406. An upper end of the cylinder 400 is closed. The elastic membrane 404 is made of a highly strong and durable rubber material such as ethylene propylene rubber (EPDM), polyurethane rubber, silicone rubber, or the like.

The holder 402 has a passage 412 communicating with a pressure chamber 410 formed by the elastic membrane 404. The cylinder 400 has a passage 414 formed at an upper portion thereof. The passage 414 of the cylinder 400 communicates with the passage 412 of the holder 402. The upper member 300 has a passage 416 communicating with the passage 414 of the cylinder 400. The passage 412 of the holder 402 is connected via the passage 414 of the cylinder 400 and the passage 416 of the upper member 300 to a fluid supply source (not shown). Thus, a pressurized fluid is supplied through the passages 416, 414, and 412 to the pressure chamber 410. Accordingly, by adjusting a pressure of a fluid to be supplied to the pressure chamber 410, the elastic membrane 404 can be expanded and contracted so as to vertically move the piston 406. Thus, the ring member 408 of the retainer ring 302 can be pressed against the polishing pad 22 under a desired pressure.

In the illustrated example, the elastic membrane 404 employs a rolling diaphragm formed by an elastic membrane having bent portions. When an inner pressure in a pressure chamber defined by the rolling diaphragm is changed, the bent portions of the rolling diaphragm are rolled so as to widen the pressure chamber. The diaphragm is not brought into sliding contact with outside components and is hardly expanded and contracted when the pressure chamber is widened. Accordingly, friction due to sliding contact can extremely be reduced, and a lifetime of the diaphragm can be prolonged.

With the above arrangement, even if the ring member 408 of the retainer ring 302 is worn out, only the retainer ring 302 can be lowered. Accordingly, a constant distance can be maintained between the lower member 306 and the polishing pad 22 even if the ring member 408 of the retainer ring 302 is worn out. Further, since the ring member 408, which is brought into contact with the polishing pad 22, and the cylinder 400 are connected by the deformable elastic membrane 404, no bending moment is produced by offset loads. Accordingly, surface pressures by the retainer ring 302 can be made uniform, and the retainer ring 302 becomes more likely to follow the polishing pad 22.

As shown in FIG. 11, the ring member 408 has a plurality of vertically extending V-shaped grooves 418. The V-shaped grooves 418 are formed in an inner surface of the ring member 408 at equal intervals. Further, a plurality of pins 349 project radially outward from a peripheral portion of the lower member 306. The pins 349 are arranged so as to engage with the V-shaped grooves 418 of the ring member 418. The pins 349 are vertically slidable within the V-shaped grooves 418 relative to the ring member 408. The pins 349 allow rotation of the top ring 20 to be transmitted via the upper member 300 and the lower member 306 to the ring member 408 so as to integrally rotate the top ring 20 and the ring member 408. Such an arrangement prevents torsion of the elastic membrane (rolling diaphragm) 404 and allows the ring member 408 to be pressed uniformly and smoothly against the polishing surface 22 during polishing. Further, a lifetime of the elastic membrane 404 can be prolonged.

As described above, pressing forces to press a semiconductor wafer are controlled by pressures of fluids to be supplied to the central portion, the ripple chamber, the outer portion, and the edge chamber of the elastic membrane 314. Accordingly, the lower member 306 should be located away upward from the polishing pad 22 during polishing. However, if the retainer ring 302 is worn out, a distance between the semiconductor wafer and the lower member 306 is varied to change a deformation manner of the elastic membrane 314. Accordingly, surface pressure distribution is also varied on the semiconductor wafer. Such a variation of the surface pressure distribution causes unstable profiles of polished semiconductor wafers.

In the illustrated example, since the retainer ring 302 can vertically be moved independently of the lower member 306, a constant distance can be maintained between the semiconductor wafer and the lower member 306 even if the ring member 408 of the retainer ring 302 is worn out. Accordingly, profiles of polished semiconductor wafers can be stabilized.

In the illustrated example, when the elastic membrane 314 is replaced with a new membrane, it is not necessary to remove the entire top ring 20 from the top ring shaft 18. Specifically, when the elastic membrane 314 is detached from the lower member 306, the bolt 312 (see FIG. 10) is first removed to detach the lower member 306 from the upper member 300 and the intermediate member 304. Then, a rotation tool is inserted into the groove 320*b* (see FIG. 9) formed at the top of the stopper 320 to rotate the stopper 320. Thus, the hook 316*a* of the edge holder 316 is disengaged from the engagement portion 320*a* of the stopper 320. Accordingly, the edge holder 316 can readily be detached from the lower member 306. Similarly, a rotation tool is inserted into the groove 322*b* formed at the top of the stopper 322 to rotate the stopper 322. Thus, the hook 318*a* of the ripple holder 318 is disengaged from the engagement portion 322*a* of the stopper 322. Accordingly, the ripple holder 318 can readily be detached from the lower member 306.

When the edge holder 316 and the ripple holder 318 are detached from the lower member 306 in the above manner, the elastic membrane 314, which has been held by the edge holder 316 and the ripple holder 318, can readily be detached from the lower member 306. The elastic membrane 314 can readily be attached to the lower member 306 by a reverse operation to the above.

Since the O-rings 332, 340, and 346 are disposed as seal members at the connecting portions between the passages of the lower member 306 and the passages of the intermediate member 304, the lower member 306 and the intermediate member 304 can be connected to each other in a state such that these passages are reliably sealed when the bolt 312 is fastened. Accordingly, special extraction and insertion of pipes are not required to replace the elastic membrane 314 with a new membrane.

In the illustrated example, the elastic membrane 314 is disposed so as to be brought into contact with substantially the entire surface of the semiconductor wafer. However, the elastic membrane 314 may be brought into contact with at least a portion of a semiconductor wafer.

Figure 13:
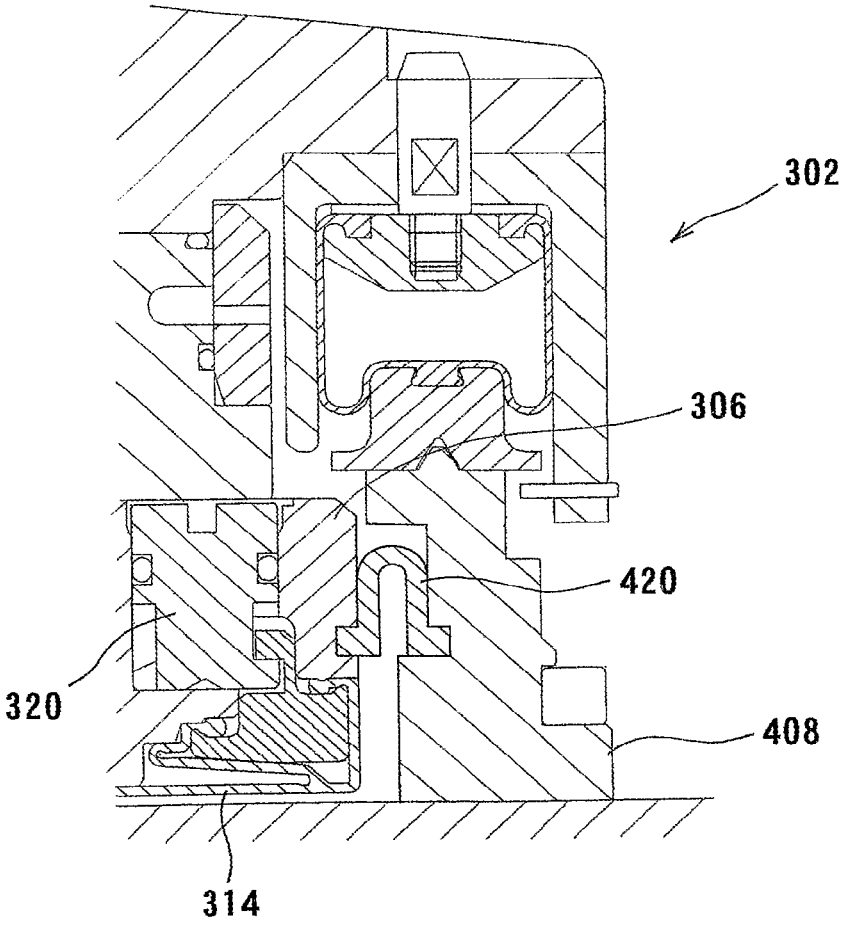
FIG. 13 is an enlarged cross-sectional view showing a variation of the top ring shown in FIG. 8.

FIG. 13 is an enlarged cross-sectional view showing a variation of the top ring 20 shown in FIG. 8. In the example shown in FIG. 13, an annular seal member 420 is provided between the retainer ring 302 and the lower member 306. The seal member 420 prevents a polishing liquid from being introduced into the interior of the top ring 20 and also prevents foreign matter from being discharged from the interior of the top ring 20. The seal member 420 is made of a soft material and can be deformed according to vertical movement of the retainer ring 302 and the lower member 306.

Figure 14:
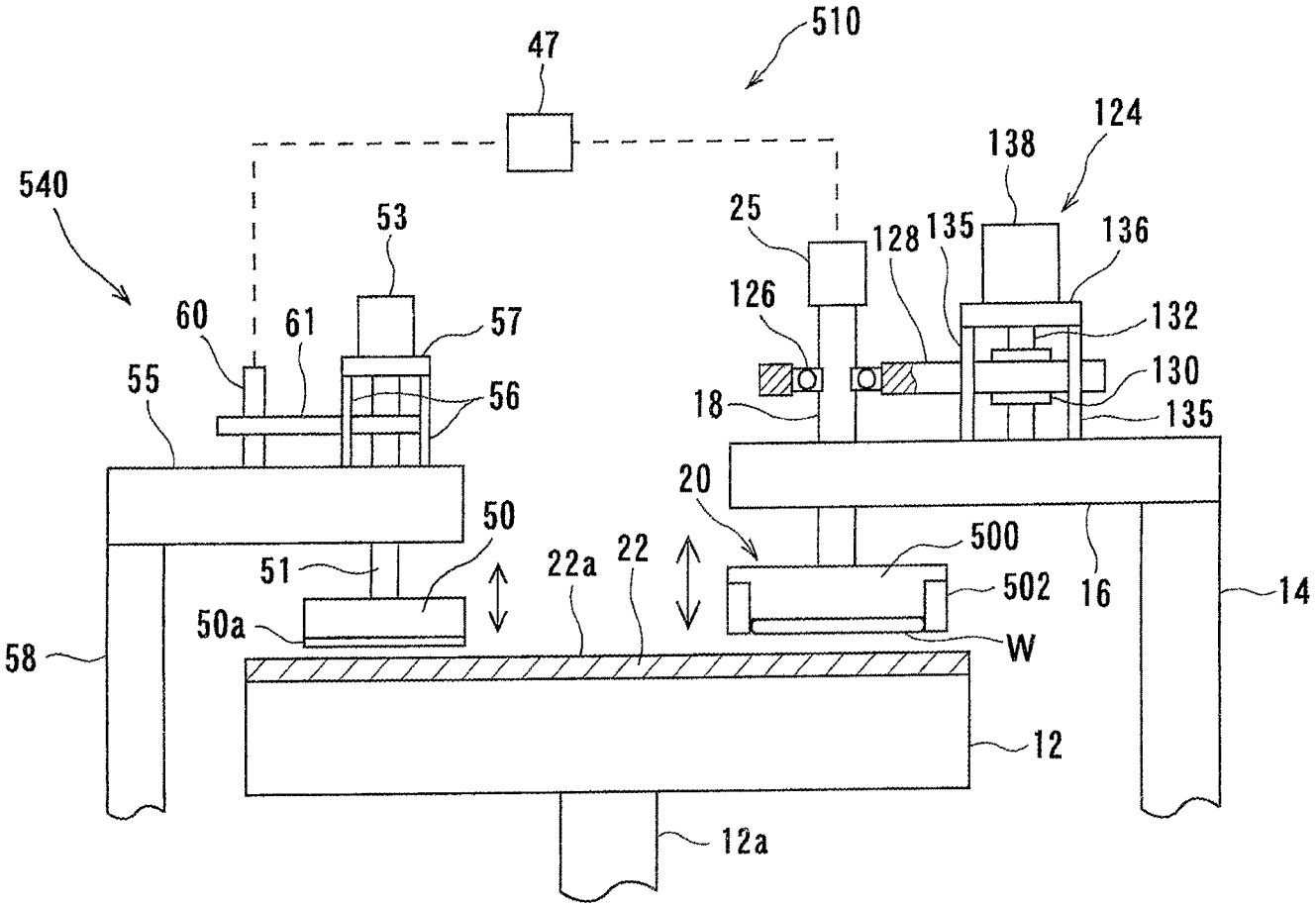
FIG. 14 is a schematic view showing a polishing apparatus according to a fifth embodiment of the present invention.

FIG. 14 is a schematic view showing a polishing apparatus 510 according to a fifth embodiment of the present invention. As shown in FIG. 14, the polishing apparatus 510 has a polishing table 12, a top ring head 16 connected to an upper end of a support shaft 14, a top ring shaft 18 mounted at a free end of the top ring head 16, and a top ring 20 coupled to a lower end of the top ring shaft 18. In the illustrated example, the top ring 20 is substantially in the form of a circular plate.

The polishing table 12 is coupled via a table shaft 12*a* to a motor (not shown) disposed below the polishing table 12. Thus, the polishing table 12 is rotatable about the table shaft 12*a*. As shown in FIG. 14, a polishing pad 22 is attached to an upper surface of the polishing table 12. An upper surface 22*a* of the polishing pad 22 forms a polishing surface to polish a semiconductor wafer W.

Various kinds of polishing pads are available on the market. For example, some of these are SUBA800, IC-1000, and IC-1000/SUBA400 (two-layer cloth) manufactured by Rodel Inc., and Surfin xxx-5 and Surfin 000 manufactured by Fujimi Inc. SUBA800, Surfin xxx-5, and Surfin 000 are non-woven fabrics bonded by urethane resin, and IC-1000 is made of rigid foam polyurethane (single layer). Foam polyurethane is porous and has a large number of fine recesses or holes formed in its surface.

The top ring shaft 18 is rotated by actuation of a motor (not shown). By rotation of the top ring shaft 18, the top ring 20 is rotated about the top ring shaft 18. Further, the top ring shaft 18 is vertically moved by a vertical movement mechanism 124. By vertical movement of the top ring shaft 18, the top ring 20 is vertically moved with respect to the top ring head 16. A rotary joint 25 is mounted on an upper end of the top ring shaft 18.

The top ring 20 has a top ring body 500 for holding a substrate such as a semiconductor wafer W on its lower surface and pressing the substrate against the polishing pad 22 and a retainer ring 502 for pressing the polishing pad 22. The retainer ring 502 is provided at a peripheral portion of the top ring body 500. The top ring head 16 is pivotable (swingable) about the support shaft 14. Thus, the top ring 20, which holds a semiconductor wafer W on its lower surface, is moved between a position at which the top ring 20 receives the semiconductor wafer W and a position above the polishing table 12 by pivotal movement of the top ring head 16. The top ring 20 is lowered to press the semiconductor wafer W against a surface (polishing surface) 22*a* of the polishing pad 10. At that time, while the top ring 20 and the polishing table 12 are respectively rotated, a polishing liquid is supplied onto the polishing pad 22 from a polishing liquid supply nozzle (not shown), which is provided above the polishing table 12. The semiconductor wafer W is brought into sliding contact with the polishing surface 22*a* on the polishing pad 10. Thus, a surface of the semiconductor wafer W is polished.

The vertical movement mechanism 124, which vertically moves the top ring shaft 18 and the top ring 20, has a first frame (bridge) 28 supporting the top ring shaft 18 in a manner such that the top ring shaft 18 is rotatable via a bearing 126, a ball screw 132 threaded into a nut 130 mounted on the first frame 128, a second frame (support stage) 136 supported by poles 135, and an AC servomotor 138 provided on the second frame 136. The second frame 136, which supports the servomotor 138, is fixed to the top ring head 16 via the poles 135.

The ball screw 132 is coupled to the servomotor 138. The top ring shaft 18 is configured to be vertically movable together with the first frame 128. Accordingly, when the servomotor 138 is driven, the first frame 128 is vertically moved via the ball screw 132. As a result, the top ring shaft 18 and the top ring 20 are vertically moved. The polishing apparatus 510 has a controller 47 operable to control various devices, including the servomotor 38, in the polishing apparatus 510. The controller 47 includes a storage device and a computer-readable medium having a program recorded therein for controlling the polishing apparatus 510.

As shown in FIG. 14, the polishing apparatus 510 has a dressing unit 540 for dressing the polishing surface 22*a* on the polishing table 12. The dressing unit 540 includes a dresser 50 which is brought into sliding contact with the polishing surface 22*a*, a dresser shaft 51 to which the dresser 50 is connected, an air cylinder 53 provided at an upper end of the dresser shaft 51, and a swing arm 55 rotatably supporting the dresser shaft 51. The dresser 50 has a dressing member 50*a* attached on a lower portion of the dresser 50. The dressing member 50*a* has diamond particles in the form of needles. These diamond particles are attached on a lower of the dressing member 50*a*. The air cylinder 53 is disposed on a support stage 57, which is supported by poles 56. The poles 56 are fixed to the swing arm 55.

The swing arm 55 is pivotable (swingable) about the support shaft 58 by actuation of a motor (not shown). The dresser shaft 51 is rotatable by actuation of a motor (not shown). Thus, the dresser 50 is rotated about the dresser shaft 51 by rotation of the dresser shaft 51. The air cylinder 53 vertically moves the dresser 50 via the dresser shaft 51 so as to press the dresser 50 against the polishing surface 22*a* of the polishing pad 22 under a predetermined pressing force.

Dressing operation of the polishing surface 22*a* on the polishing pad 22 is performed as follows. The dresser 50 is pressed against the polishing surface 22*a* by the air cylinder 53. Simultaneously, pure water is supplied onto the polishing surface 22*a* from a pure water supply nozzle (not shown). At that state, the dresser 50 is rotated about the dresser shaft 51, and the lower surface (diamond particles) of the dressing member 50*a* is brought into contact with the polishing surface 22*a*. Thus, the dresser 50 removes a portion of the polishing pad 22 so as to dress the polishing surface 22*a*.

The polishing apparatus 510 in the present embodiment utilizes the dresser 50 to measure the amount of wear of the polishing pad 22. Specifically, the dressing unit 540 includes a displacement sensor (polishing pad wear detector) 60 for measuring displacement of the dresser 50. The displacement sensor 60 is provided on an upper surface of the swing arm 55. A target plate 61 is fixed to the dresser shaft 51. The target plate 61 is vertically moved by vertical movement of the dresser 50. The displacement sensor 60 is inserted into a hole of the target plate 61. The displacement sensor 60 measures displacement of the target plate 61 to measure displacement of the dresser 50. The displacement sensor 60 may comprise any type of sensors including a laser sensor, an ultrasonic sensor, an eddy-current sensor, and a linear scale sensor.

In the present embodiment, the amount of wear of the polishing pad 22 is measured as follows. First, the air cylinder 53 is operated to bring the dresser 50 into contact with a polishing surface 22*a* of an unused polishing pad 22. At that state, the displacement sensor 60 measures an initial position of the dresser 50 and stores the initial position in the storage device of the controller (arithmetical unit) 47. After completion of a polishing process for one or more semiconductor wafers W, the dresser 50 is brought into contact with the polishing surface 22*a*. At that state, the position of the dresser 50 is measured. Since the position of the dresser 50 is shifted downward by the amount of wear of the polishing pad 22, the controller 47 calculates a difference between the initial position and the measured position of the dresser 50 after polishing to obtain the amount of wear of the polishing pad 22. Thus, the amount of wear of the polishing pad 22 is calculated based on the position of the dresser 50.

In the controller 47, the total amount of wear of the polishing pad 22 is compared with a predetermined set value. If the total amount of wear of the polishing pad 22 exceeds the predetermined set value, a signal to indicate that the polishing pad 22 should be replaced is sent from the controller 47. The amount of wear of the polishing pad 22 (the amount of polishing) for a polishing process or sets of polishing processes is stored in the controller 47 so that variation of the amount of wear can be monitored by the controller 47. In this case, an operational recipe of the dresser 50 (dressing conditions such as a dressing time, a rotational speed of the dresser 50, and a pressing force to press the dresser 50 against the polishing pad 22) may be changed by the controller 47 to maintain a constant amount of wear of the polishing pad 22 for each polishing process or each set of polishing processes.

Based on the amount of wear of the polishing pad 22, the controller 47 controls the servomotor 138 so that a distance between the top ring 20 and the polishing surface 22*a* of the polishing pad 22 is equal to a predetermined value. Specifically, the controller 47 calculates an optimal position of the top ring 20 to polish a semiconductor wafer based on the amount of wear of the polishing pad 22 (displacement of the polishing surface 22*a*) and stores the optimal position in the storage device. When a semiconductor wafer W is polished, the servomotor 138 is driven in the state shown in FIG. 14 so as to lower the first frame 128 and the top ring 20 which holds the semiconductor wafer W. At that time, the controller 47 controls the servomotor 138 and stops the servomotor 138 when the top ring 20 reaches the calculated optimal position. The semiconductor wafer W held on the lower surface of the top ring 20 is pressed against the polishing pad 22 and polished at the calculated optimal position.

Next, a top ring which is suitably used as the top ring 20 in the fifth embodiment will be described below in detail. FIGS. 15 through 18 are cross-sectional views showing an example of the top ring 20 along a plurality of radial directions of the top ring 20. FIG. 19 is a plan view showing a lower member shown in FIGS. 15 through 18.

As shown in FIGS. 15 through 18, the top ring 20 has a top ring body 500 for pressing a semiconductor wafer W against the polishing surface 22*a* and a retainer ring 502 for directly pressing the polishing surface 22*a*. The top ring body 500 includes an upper member 600 in the form of a circular plate, an intermediate member 604 attached to a lower surface of the upper member 600, and a lower member 606 attached to a lower surface of the intermediate member 604.

The retainer ring 502 is attached to a peripheral portion of the upper member 600. The upper member 600 is connected to the top ring shaft 18 by a bolt 608. Further, the intermediate member 604 is fixed to the upper member 600 by a bolt (not shown), and the lower member 606 is fixed to the upper member 600 by a bolt (not shown). The top ring body 500 including the upper member 600, the intermediate member 604, and the lower member 606 is made of resin such as engineering plastics (e.g., PEEK).

The top ring 20 has an elastic membrane 614 attached to a lower surface of the lower member 606. The elastic membrane 614 is brought into contact with a rear face of a semiconductor wafer held by the top ring 20. The elastic membrane 614 is held on the lower surface of the lower member 606 by an edge holder 616 disposed radially outward and annular ripple holders 618 and 619 disposed radially inward of the edge holder 616. The elastic membrane 614 is made of a highly strong and durable rubber material such as ethylene propylene rubber (EPDM), polyurethane rubber, silicone rubber, or the like.

The edge holder 616 is held by the ripple holder 618, and the ripple holder 618 is held on the lower surface of the lower member 606 by a plurality of stoppers 620. The ripple holder 619 is held on the lower surface of the lower member 606 by a plurality of stoppers 622. As shown in FIG. 19, the stoppers 620 and the stoppers 622 are arranged along a circumferential direction of the top ring 20 at equal intervals.

Figure 15:
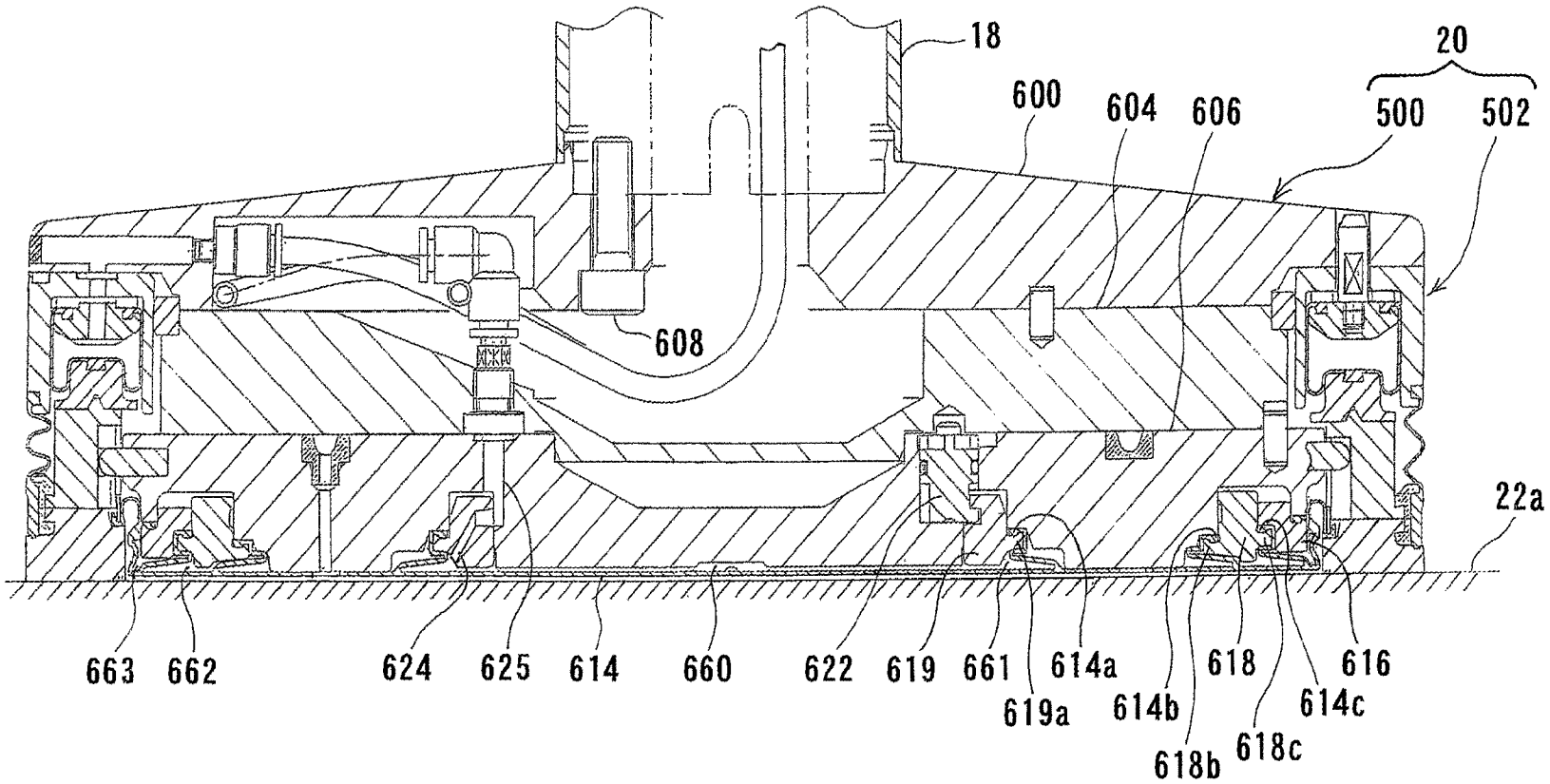
FIGS. 15 through 18 are cross-sectional views of a top ring which is suitably used in the polishing apparatus shown in FIG. 14.

As shown in FIG. 15, a central chamber 660 is formed at a central portion of the elastic membrane 614. The ripple holder 619 has a passage 624 communicating with the central chamber 660. The lower member 606 has a passage 625 communicating with the passage 624. The passage 624 of the ripple holder 619 and the passage 625 of the lower member 606 are connected to a fluid supply source (not shown). Thus, a pressurized fluid is supplied through the passage 625 and 624 to the central chamber 660 of the elastic membrane 314.

The ripple holder 618 has claws 618*b* and 618*c* for pressing a ripple 614*b* and an edge 614*c* of the elastic membrane 614 against the lower surface of the lower member 606. The ripple holder 619 has a claw 619*a* for pressing a ripple 614*a* of the elastic membrane 614 against the lower surface of the lower member 606.

Figure 16:
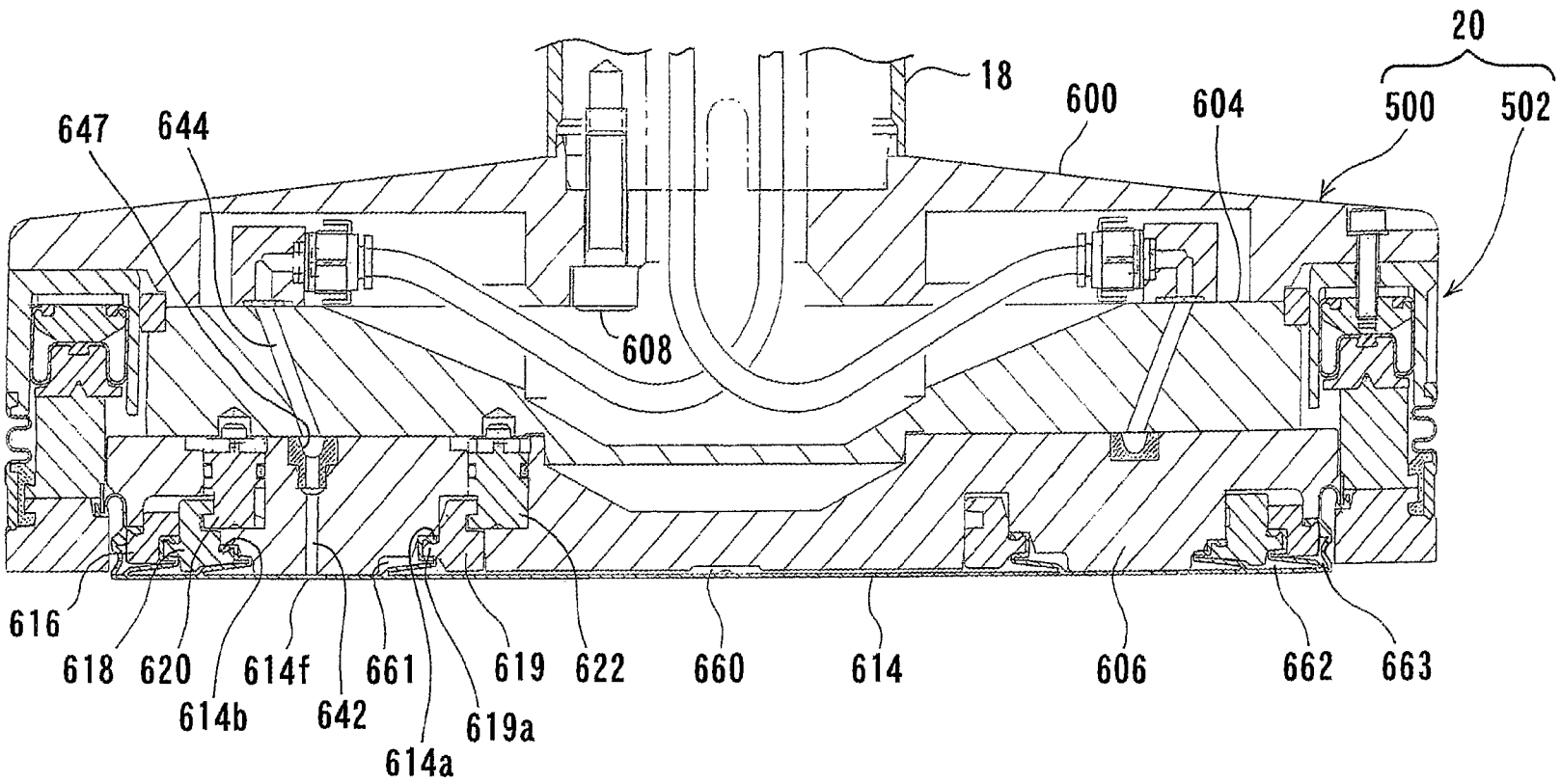

As shown in FIG. 16, an annular ripple chamber 661 is formed between the ripple 614*a* and the ripple 614*b* of the elastic membrane 614. A gap 614*f* is formed between the ripple holder 618 and the ripple holder 619 of the elastic membrane 614. The lower member 606 has a passage 642 communicating with the gap 614*f*. Further, the intermediate member 604 has a passage 644 communicating with the passage 642 of the lower member 606. An annular groove 647 is formed at a connecting portion between the passage 642 of the lower member 606 and the passage 644 of the intermediate member 604. The passage 642 of the lower member 606 is connected via the annular groove 647 and the passage 644 of the intermediate member 604 to a fluid supply source (not shown). Thus, a pressurized fluid is supplied through the passages to the ripple chamber 661. Further, the passage 642 is selectively connected to a vacuum pump (not shown). When the vacuum pump is operated, a semiconductor wafer is attracted to the lower surface of the elastic membrane 614 by suction.

Figure 17:
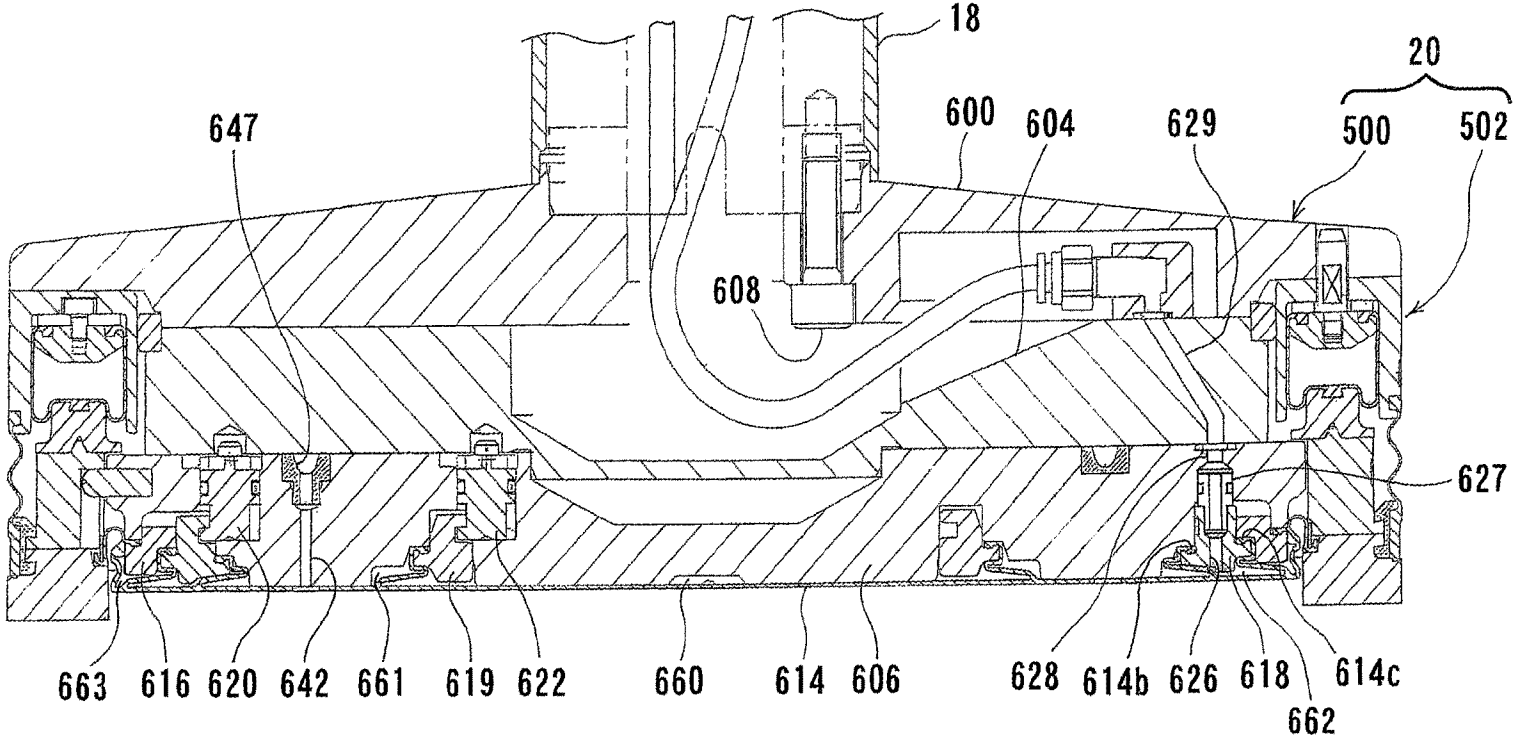

As shown in FIG. 17, the ripple holder 618 has a passage 626 communicating with an annular outer chamber 662 formed by the ripple 614*b* and the edge 614*c* of the elastic membrane 614. Further, the lower member 606 has a passage 628 communicating with the passage 626 of the ripple holder 618 via a connector 627. The intermediate member 604 has a passage 629 communicating with the passage 628 of the lower member 606. The passage 626 of the ripple holder 618 is connected via the passage 628 of the lower member 606 and the passage 629 of the intermediate member 604 to a fluid supply source (not shown). Thus, a pressurized fluid is supplied through the passages 629, 628, and 626 to the outer chamber 662 of the elastic membrane 614.

Figure 18:
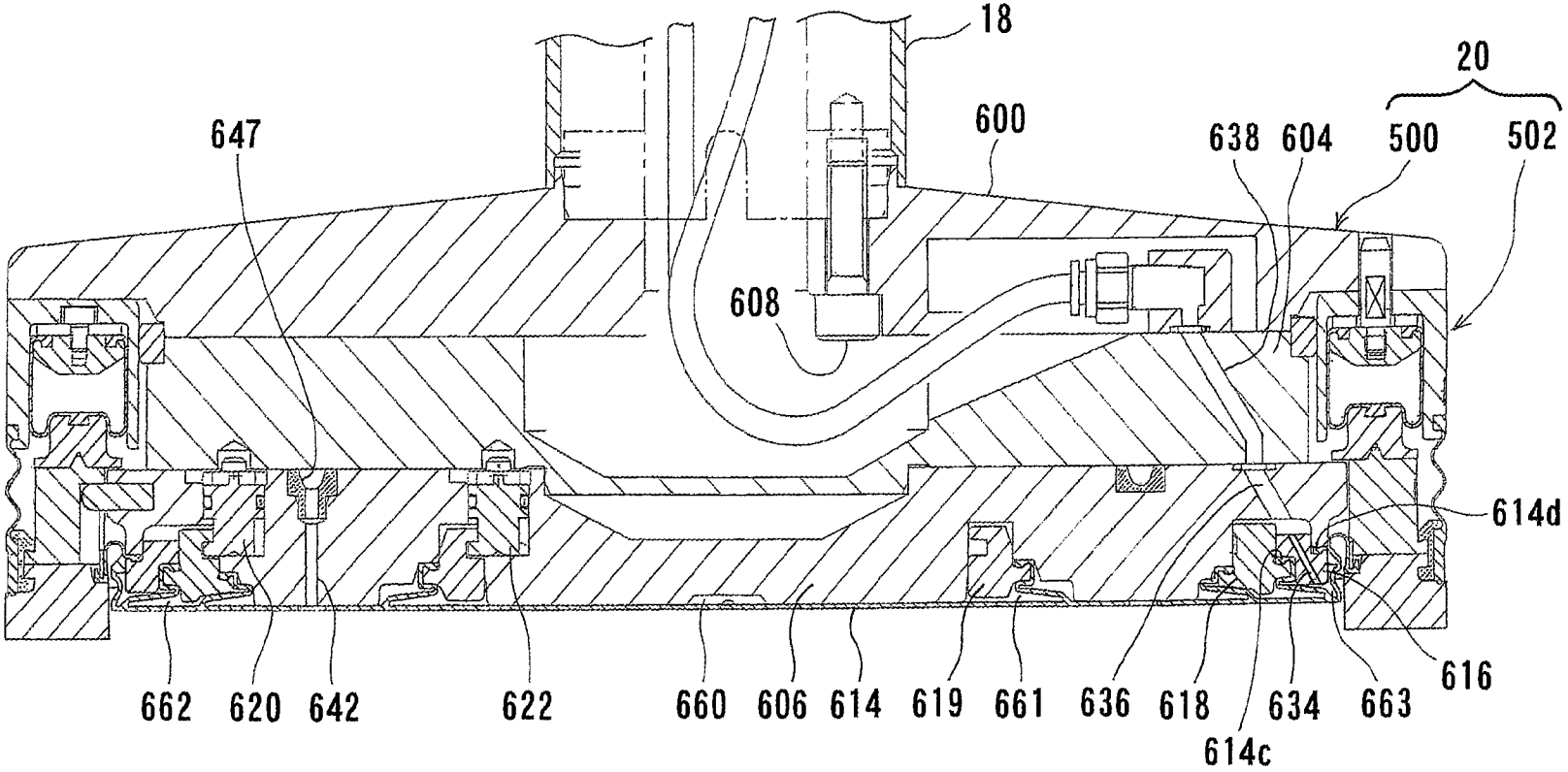
Figure 19:
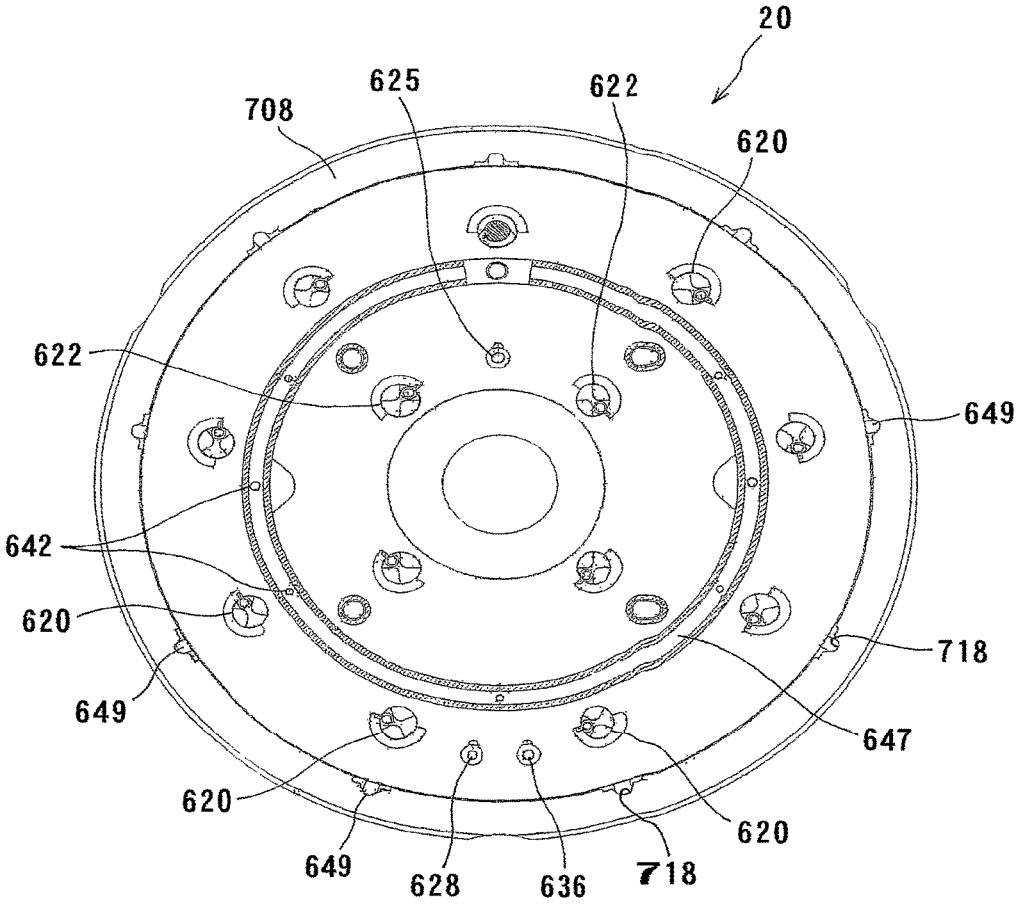
FIG. 19 is a plan view showing a lower member of the top ring shown in FIGS. 15 through 18.

As shown in FIG. 18, the edge holder 616 has a claw for holding an edge 614*d* of the elastic membrane 614 on the lower surface of the lower member 606. The edge holder 616 has a passage 634 communicating with an annular edge chamber 663 formed by the edges 614*c* and 614*d* of the elastic membrane 614. The lower member 606 has a passage 636 communicating with the passage 634 of the edge holder 616. The intermediate member 604 has a passage 638 communicating with the passage 636 of the lower member 606. The passage 634 of the edge holder 616 is connected via the passage 636 of the lower member 606 and the passage 638 of the intermediate member 604 to a fluid supply source (not shown). Thus, a pressurized fluid is supplied through the passages 638, 636, and 634 to the edge chamber 663 of the elastic membrane 614.

As described above, with the top ring 20 in the present embodiment, pressing forces to press a semiconductor wafer against the polishing pad 22 can be adjusted at local areas of the semiconductor wafer by adjusting pressures of fluids to be supplied to the respective pressure chambers formed between the elastic membrane 614 and the lower member 606 (i.e., the central chamber 660, the ripple chamber 661, the outer chamber 662, and the edge chamber 663).

Figure 20:
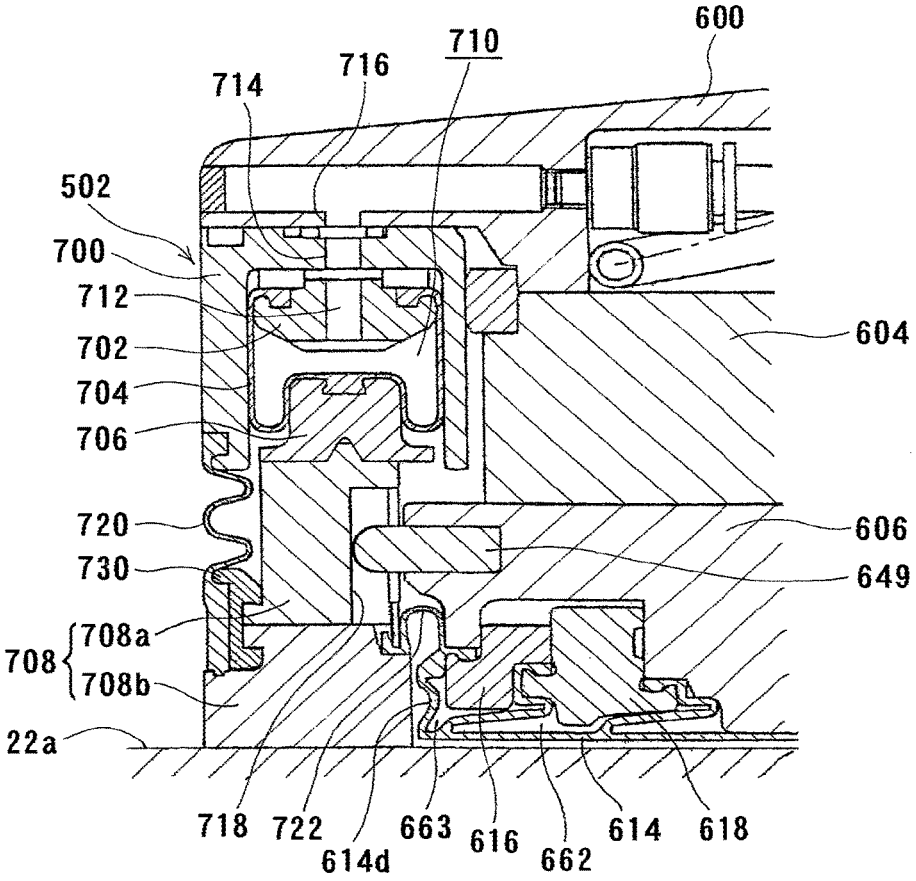
FIG. 20 is an enlarged view of a retainer ring shown in FIG. 15.

FIG. 20 is an enlarged view of the retainer ring 502 shown in FIG. 15. The retainer ring 502 serves to hold a peripheral edge of a semiconductor wafer. As shown in FIG. 20, the retainer ring 502 has a cylinder 700, a holder 702 attached to an upper portion of the cylinder 700, an elastic membrane 704 held in the cylinder 700 by the holder 702, a piston 706 connected to a lower end of the elastic membrane 704, and a ring member 708 which is pressed downward by the piston 706. An upper end of the cylinder 700 is closed. A connection sheet 720, which can be expanded and contracted in a vertical direction, is provided between an outer circumferential surface of the ring member 708 and a lower end of the cylinder 700. The connection sheet 720 is disposed so as to fill a gap between the ring member 708 and the cylinder 700. Thus, the connection sheet 720 serves to prevent a polishing liquid (slurry) from being introduced into the gap between the ring member 708 and the cylinder 700.

The elastic membrane 614 includes a seal portion 722 connecting the elastic membrane 614 to the retainer ring 502 at an edge (periphery) of the elastic membrane 614. The seal portion 722 has a shape curved upward. The seal portion 722 is disposed so as to fill a gap between the elastic membrane 614 and the ring member 708. The seal portion 722 is made of a deformable material. The seal portion 722 serves to prevent a polishing liquid from being introduced into the gap between the elastic membrane 614 and the ring member 708 while allowing the top ring body 500 and the retainer ring 502 to be moved relative to each other. In the present embodiment, the seal portion 722 is formed integrally with the edge 614*d* of the elastic membrane 614 and has a U-shaped cross-section.

In a case where the connection sheet 720 or the seal portion 722 is not provided, a polishing liquid may be introduced into an interior of the top ring 20 so as to inhibit normal operation of the top ring body 500 and the retainer ring 502 of the top ring 20. In the present embodiment, the connection sheet 720 and the seal portion 722 prevent a polishing liquid from being introduced into the interior of the top ring 20. Accordingly, it is possible to operate the top ring 20 normally. The elastic membrane 704, the connection sheet 720, and the seal portion 722 is made of a highly strong and durable rubber material such as ethylene propylene rubber (EPDM), polyurethane rubber, silicone rubber, or the like.

The ring member 708 is divided into an upper ring member 708*a* and a lower ring member 708*b*. The upper ring member 708*a* is brought into contact with the piston 706. The lower ring member 708*b* is brought into contact with the polishing surface 22*a*. The upper ring member 708*a* and the lower ring member 708*b* have flange portions extending in a circumferential direction on outer circumferential surfaces of the ring members 708*a* and 708*b*. The flange portions are held by a clamp 730 so that the upper ring member 708*a* and the lower ring member 708*b* are fastened.

Figure 21:
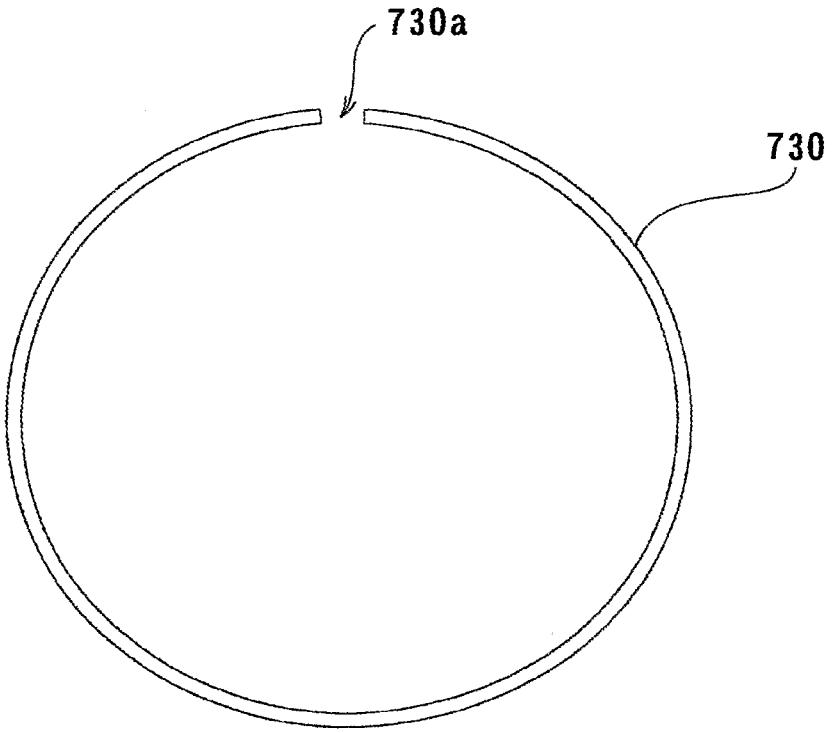
FIG. 21 is a plan view of a clamp in the retainer ring shown in FIG. 20.

FIG. 21 is a plan view of the clamp 730 shown in FIG. 20. The clamp 730 is made of a flexible material. An initial shape of the clamp 730 is substantially linear. When the clamp 730 is attached to the flange portions of the ring member 708, the clamp 730 is deformed into an annular shape having a notch 730*a* as shown in FIG. 21.

Figure 22A:
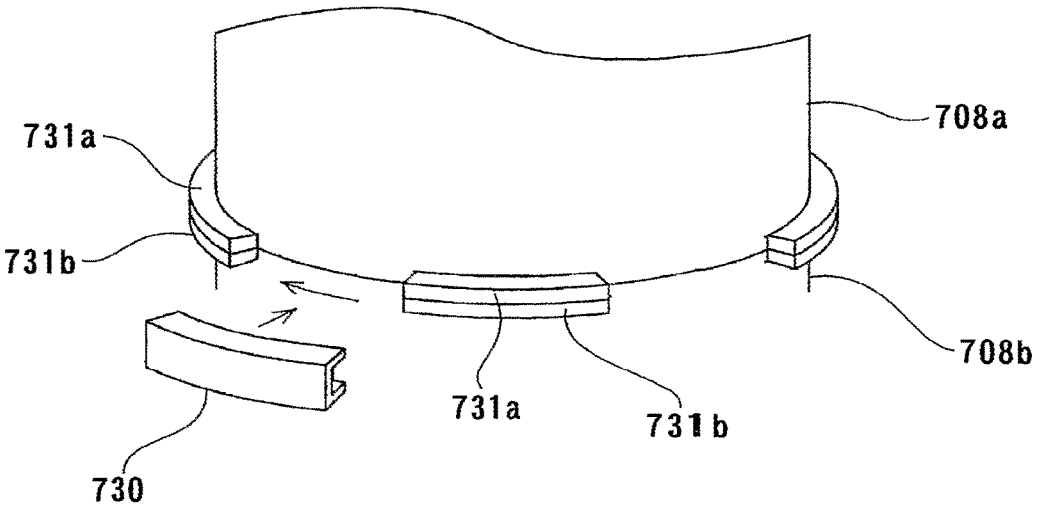
FIG. 22A is a perspective view showing another example of a clamp in the retainer ring shown in FIG. 20.

FIG. 22A is a perspective view showing another example of the clamp 730. A plurality of clamps 730 made of a hard material are used in this example. FIG. 22A shows only one of the clamps 730. The upper ring member 708*a* has a plurality of flange portions 731*a* projecting outward on an outer circumferential surface of the upper ring member 708*a*. The lower ring member 708*b* has a plurality of flange portions 731*b* projecting outward on an outer circumferential surface of the lower ring member 708*b*. Each clamp 730 has a shape curved along an outer circumferential surface of the ring member 708.

Figure 22B:
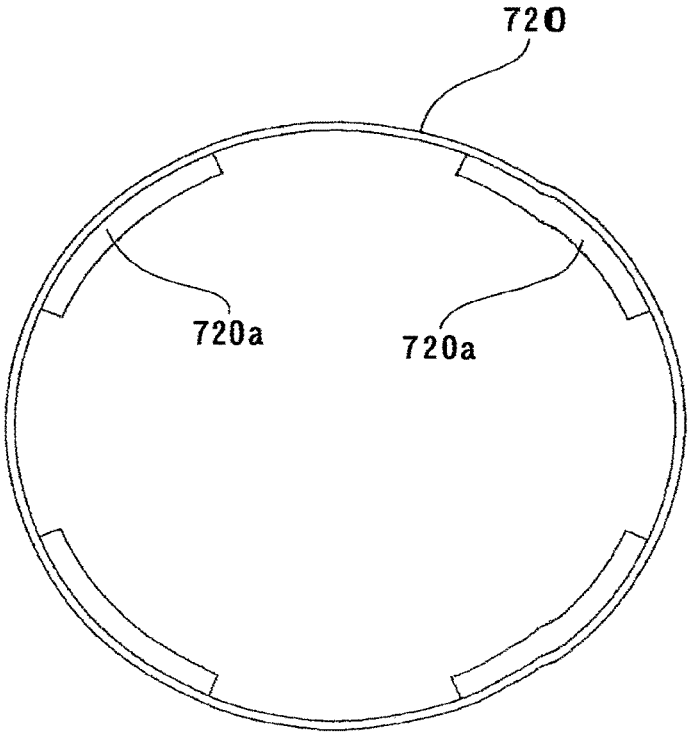
FIG. 22B is a plan view showing a connection sheet used for the clamp shown in FIG. 22A.

These clamps 730 are attached to the ring member 708 as follows. First, the upper ring member 708*a* and the lower ring member 708*b* are brought into contact with each other in a state such that the flange portions 731*a* and 731*b* are aligned with each other. Then, the clamp 730 is located at a gap between adjacent flange portions and moved horizontally to clamp the flange portions 731*a* and 731*b*. Thus, the upper ring member 708*a* and the lower ring member 708*b* are fastened to each other by the clamp 730. In this example, as shown in FIG. 22B, the connection sheet 720 has a plurality of projections 720*a* formed on an inner circumferential surface of the connection sheet 720. The projections 720*a* are fitted into gaps between the flange portions. The connection sheet 720 is attached to the ring member 708 so that the projections 720*a* are fitted into the gaps between the flange portions. Thus, the clamps 730 are fixed in place.

As shown in FIG. 20, the holder 702 has a passage 712 communicating with a pressure chamber 710 formed by the elastic membrane 704. The cylinder 700 has a passage 714 formed at an upper portion thereof. The passage 714 of the cylinder 700 communicates with the passage 712 of the holder 702. The upper member 600 has a passage 716 communicating with the passage 714 of the cylinder 700. The passage 712 of the holder 702 is connected via the passage 714 of the cylinder 700 and the passage 716 of the upper member 600 to a fluid supply source (not shown). Thus, a pressurized fluid is supplied through the passages 716, 714, and 712 to the pressure chamber 710. Accordingly, by adjusting a pressure of a fluid to be supplied to the pressure chamber 710, the elastic membrane 704 can be expanded and contracted so as to vertically move the piston 706. Thus, the ring member 708 of the retainer ring 502 can be pressed against the polishing pad 22 under a desired pressure.

The elastic membrane 704 may have a plurality of separation membranes (not shown) disposed along a circumferential direction so as to form a plurality of pressure chambers 710, which are divided in the circumferential direction, inside of the elastic membrane 704. It is desirable that the number of the pressure chambers 710 is not less than three. In this case, the passages 712, 714, and 716 are formed independently for each pressure chamber 710. Pressure controllers (not shown) are provided for the respective pressure chambers 710. Thus, fluids independently controlled in pressure by the pressure controllers are supplied through the passages 712, 714, and 716 into the respective pressure chambers 710. Accordingly, by adjusting pressures of fluids to be supplied to the pressure chambers 710, the elastic membrane 704 can be expanded and contracted so as to vertically move the piston 706. Thus, the ring member 708 of the retainer ring 502 can be pressed against the polishing pad 22 with a desired pressure distribution.

In the above example, a non-uniform pressure distribution can be produced along a circumferential direction of the retainer ring 502 by independently adjusting pressures of fluids to be supplied to a plurality of pressure chambers 710. Specifically, the ring member 708 and a plurality of pressure chambers 710 to press the ring member 708 against the polishing pad 22 serve as a pressure control mechanism for producing a non-uniform pressure distribution along a circumferential direction of the retainer ring 502.

For example, such a pressure control mechanism can control pressures under which the retainer ring 502 presses the polishing pad 22 so that portions located downstream in a rotation direction of the polishing table 12 are pressed under pressures higher than portions located upstream in the rotation direction of the polishing table 12. In this case, it is necessary to dynamically vary pressures to be supplied to the respective pressure chambers 710 according to rotation of the top ring 20. When the top ring 20 is rotated at a high rotational speed, it becomes difficult to control pressures so as to follow the rotation. For example, in order to overcome the difficulty of pressure control, pressure control valves (not shown) may be provided for the respective pressure chambers 710. The pressure control valves may be switched according to the rotation of the top ring 20 so as to introduce fluids having predetermined pressures into the respective pressure chambers 710.

For example, a reference point (marking) may be provided on the retainer ring 502. A plurality of proximity sensors may be disposed around the retainer ring 502 at equal intervals. The reference point may be detected by the proximity sensors when the top ring 20 is rotated. In this case, pressures under which the retainer ring 502 presses the polishing pad 22 can be controlled based on detected results of the proximity sensors. It is desirable that the number of the proximity sensors is not less than three. Alternatively, vertical displacements of the retainer ring 502 or actual pressing loads to press the polishing surface which correspond to the respective pressure chambers 710 may be detected to control pressures under which the retainer ring 502 presses the polishing pad 22 based on the detected results.

In the illustrated example, the elastic membrane 704 employs a rolling diaphragm formed by an elastic membrane having bent portions. When an inner pressure in a pressure chamber defined by the rolling diaphragm is changed, the bent portions of the rolling diaphragm are rolled so as to widen the pressure chamber. The diaphragm is not brought into sliding contact with outside components and is hardly expanded and contracted when the pressure chamber is widened. Accordingly, friction due to sliding contact can extremely be reduced, and a lifetime of the diaphragm can be prolonged. Further, pressing forces under which the retainer ring 502 presses the polishing pad 22 can accurately be adjusted.

With the above arrangement, only the retainer ring 502 can be lowered. Accordingly, a constant distance can be maintained between the lower member 606 and the polishing pad 22 even if the ring member 708 of the retainer ring 502 is worn out. Further, since the ring member 708, which is brought into contact with the polishing pad 22, and the cylinder 700 are connected by the deformable elastic membrane 704, no bending moment is produced by offset loads. Accordingly, surface pressures by the retainer ring 502 can be made uniform, and the retainer ring 502 becomes more likely to follow the polishing pad 22.

As shown in FIGS. 19 and 20, the upper ring member 708*a* has a plurality of vertically extending V-shaped grooves 718. The V-shaped grooves 718 are formed in an inner surface of the upper ring member 708*a* at equal intervals. Further, a plurality of pins 649 project radially outward from a peripheral portion of the lower member 606. The pins 649 are arranged so as to engage with the V-shaped grooves 718 of the ring member 708. The pins 649 are vertically slidable within the V-shaped grooves 718 relative to the ring member 708. The pins 649 allow rotation of the top ring body 500 to be transmitted via the upper member 600 and the lower member 606 to the retainer ring 502 so as to integrally rotate the top ring body 500 and the retainer ring 502. Such an arrangement prevents torsion of the elastic membrane (rolling diaphragm) 704 and allows the ring member 708 to be pressed uniformly and smoothly against the polishing surface 22 during polishing. Further, a lifetime of the elastic membrane 704 can be prolonged.

Figure 23:
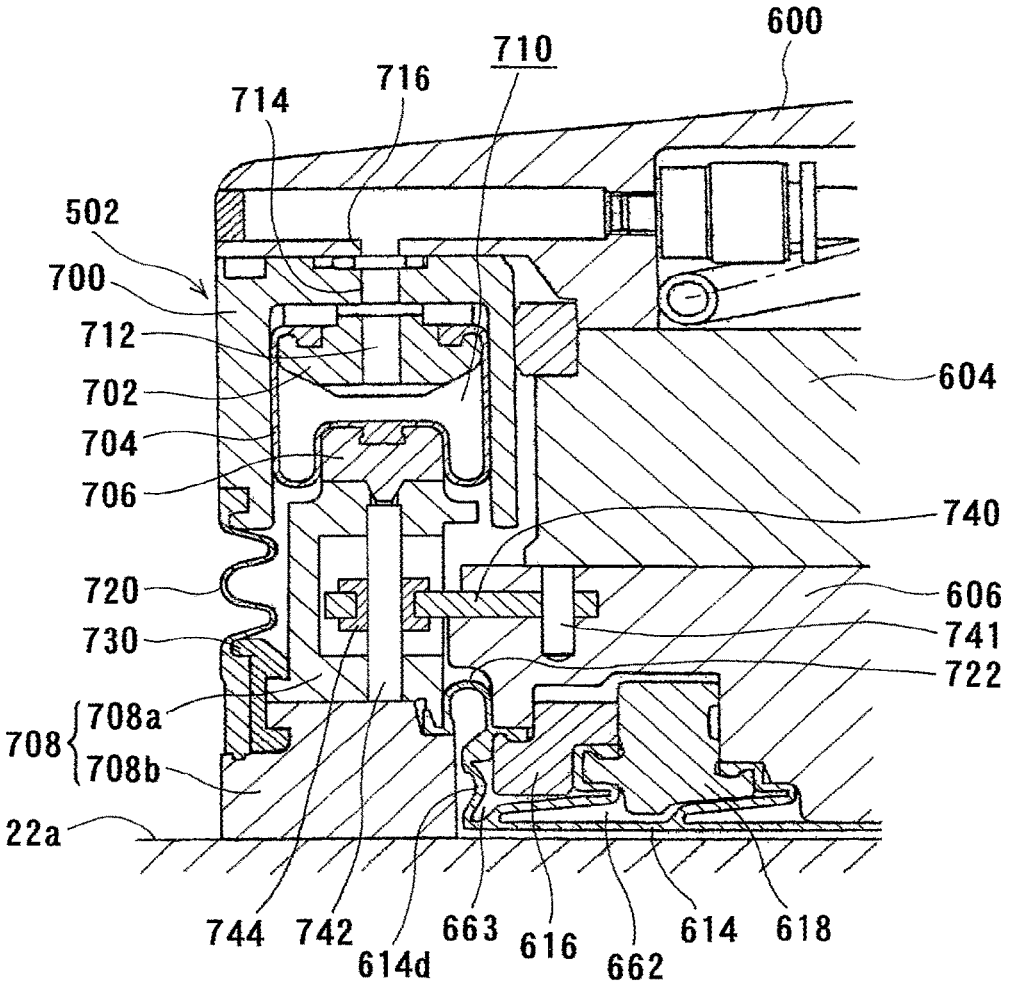
FIG. 23 is a partial cross-sectional view showing another example of a top ring which is suitably used in the polishing apparatus shown in FIG. 14.
Figure 24:
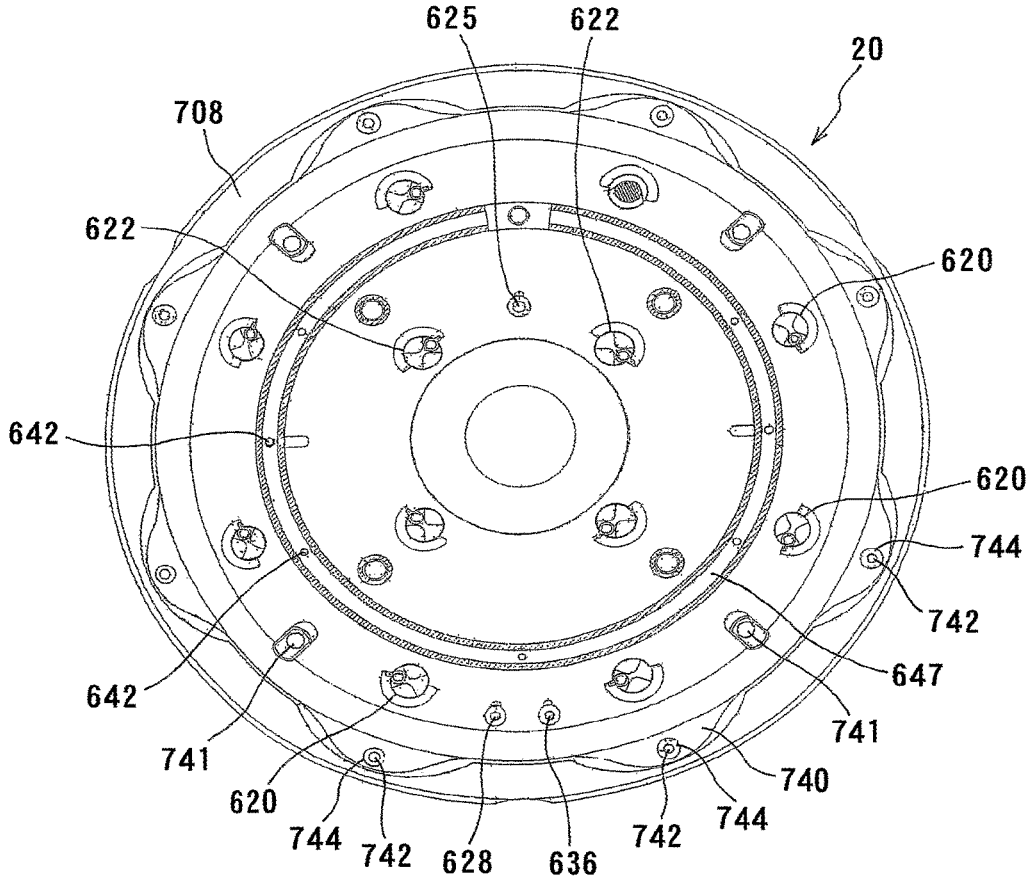
FIG. 24 is a plan view of a lower member of the top ring shown in FIG. 23.

Since rotation of the top ring body 500 is transmitted to the retainer ring 502 by engagement of the pins 649 provided on the top ring body 500 with the V-shaped grooves 718 of the retainer ring 502, the pins 649 may be brought into sliding contact with the V-shaped grooves 718 to form recesses in surfaces of the V-shaped grooves 718. Such recesses may forcibly position the pins 649 so as to cause unstable movement of the retainer ring 502. FIG. 23 is a partial cross-sectional view showing a top ring capable of resolving such a drawback. FIG. 24 is a plan view of a lower member of the top ring shown in FIG. 23.

As shown in FIGS. 23 and 24, an annular sheet member 740 is fixed to the lower member 606 of the top ring body 500 by pins 741. A plurality of slide rings 744 are attached to peripheral portions of the sheet member 740 at equal intervals. The upper ring member 708*a* of the retainer ring 502 has a plurality of drive pins 742 extending along a vertical direction at equal intervals. The drive pins 742 are inserted into the slide rings 744 so as to be slidable within the slide rings 744. Rotation of the top ring body 500 is transmitted via the sheet member 740, the slide rings 744, and the drive pins 742 to the retainer ring 502. Thus, the top ring body 500 and the retainer ring 502 are rotated integrally with each other.

In this example, since the drive pins 742 are brought into contact with the slide rings 744 with large contact areas, it is possible to reduce wear of the drive pins 742 and the slide rings 744. Accordingly, the ring member 708 can be moved smoothly in the vertical direction. Thus, it is possible to operate the retainer ring 502 normally. Rubber is suitable for a material of the sheet member 740. When the sheet member 740 is made of rubber, vibration to be transmitted between the top ring body 500 and the retainer ring 502 can be reduced.

As described above, pressing forces to press a semiconductor wafer are controlled by pressures of fluids to be supplied to the central chamber 660, the ripple chamber 661, the outer chamber 662, and the edge chamber 663 of the elastic membrane 614. Accordingly, the lower member 606 should be located away upward from the polishing pad 22 during polishing. However, if the retainer ring 502 is worn out, a distance between the semiconductor wafer and the lower member 606 is varied to change a deformation manner of the elastic membrane 614. Accordingly, surface pressure distribution is also varied on the semiconductor wafer. Such a variation of the surface pressure distribution causes unstable profiles of polished semiconductor wafers.

In the illustrated example, since the retainer ring 502 can vertically be moved independently of the lower member 606, a constant distance can be maintained between the semiconductor wafer and the lower member 606 even if the ring member 708 of the retainer ring 502 is worn out. Accordingly, profiles of polished semiconductor wafers can be stabilized.

In the illustrated example, the elastic membrane 614 is disposed so as to be brought into contact with substantially the entire surface of the semiconductor wafer. However, the elastic membrane 614 may be brought into contact with at least a portion of a semiconductor wafer.

During polishing, since the retainer ring 502 of the top ring 20 is brought into sliding contact with the polishing surface 22*a*, the retainer ring 502 (the lower ring member 708*b*) is gradually worn out. When the retainer ring 502 is worn out to some extent, the ring member 708 cannot be pressed against the polishing surface 22*a* under a desired pressing force. As a result, profiles of semiconductor wafers are varied. Accordingly, the present embodiment employs a retainer ring wear detector provided on a pusher to measure the amount of wear of the retainer ring 502.

Figure 25:
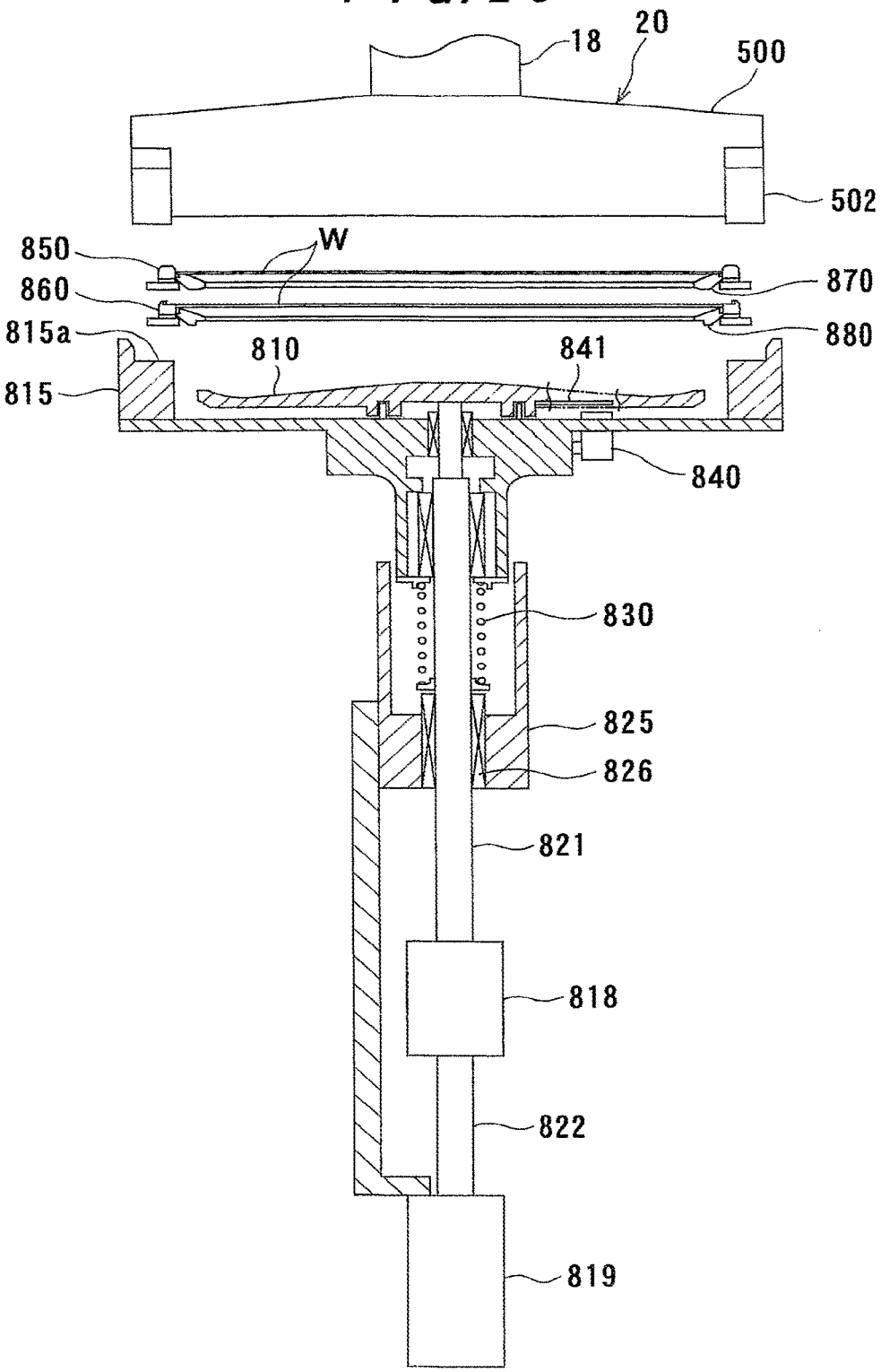
FIG. 25 is a cross-sectional view showing a pusher having a retainer ring wear detector.
Figure 26:
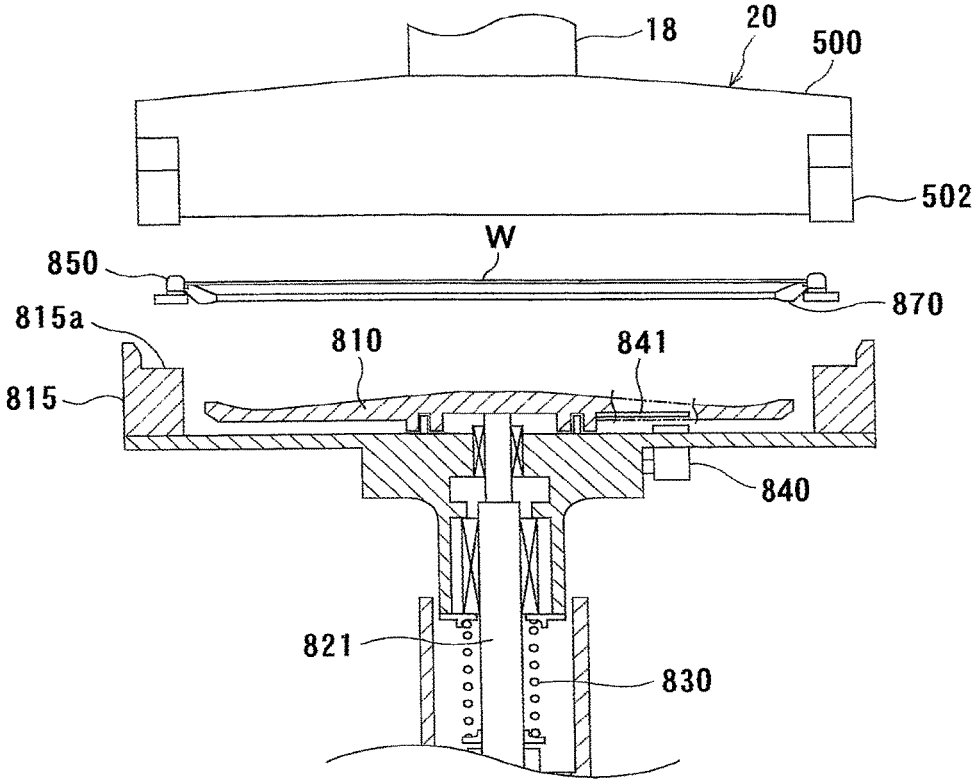
FIGS. 26 through 29 are cross-sectional views explanatory of operation of the pusher shown in FIG. 25.

FIG. 25 is a cross-sectional view showing a pusher having a retainer ring wear detector. As shown in FIG. 25, the pusher 800 has a push stage 810 for lifting a semiconductor wafer to allow the semiconductor wafer to be held on the elastic membrane 614 of the top ring body 500, a retainer ring guide 815 for centering the top ring 20 and the pusher 800, a first air cylinder 818 for vertically moving the push stage 810, and a second air cylinder 819 for vertically moving the push stage 810 and the retainer ring guide 815.

The push stage 810 is coupled via a first vertical shaft 821 to the first air cylinder 818. The first air cylinder 818 is coupled via a second vertical shaft 822 to the second air cylinder 819. The first vertical shaft 821 is slidably supported by a slide guide 826, which is housed in a housing 825. The retainer ring guide 815 is supported via a spring 830 by the first vertical shaft 821. The retainer ring guide 815 has a recess 815*a* formed at its upper end surface. The recess 815*a* is brought into contact with a lower surface of the ring member 708 of the retainer ring 502. When the second air cylinder 819 is operated to lift the retainer ring guide 815 and the push stage 810, a lower portion of the ring member 708 is fitted into the recess 815*a*. Thus, the top ring 20 is centered on the pusher 800. At that time, the spring 830 is pressed downward by the retainer ring guide 815 to absorb impact when the top ring 20 is brought into contact with the pusher 800.

As shown in FIG. 25, an eddy-current sensor (retainer ring wear detector) 840 is attached to the retainer ring guide 815. The push stage 810 has a metal target plate 841 facing the eddy-current sensor 840. The eddy-current sensor 840 measures a distance between the push stage 810 and the retainer ring guide 815 with use of the target plate 841. The retainer ring wear detector is not limited to an eddy-current sensor and may comprise any type of sensors including a laser sensor, an ultrasonic sensor, and a linear scale sensor.

Two linear transporters 850 and 860 to transfer a semiconductor wafer W and two wafer trays 870 and 880 held by the linear transporters 850 and 860 are disposed between the top ring 20 and the pusher 800. Semiconductor wafers are loaded on or unloaded from the top ring 20 via the wafer trays 870 and 880 by the push stage 810. The linear transporters 850 and 860 serve to transfer a semiconductor wafer W between the polishing apparatus and a transfer robot (not shown). The linear transporters 850 and 860 are configured to be movable in a horizontal direction. The linear transporter 850 is used for loading a semiconductor wafer, whereas the linear transporter 860 is used for unloading a semiconductor wafer. The linear transporter 850 is disposed above the linear transporter 860. Although the linear transporter 850 and the linear transporter 860 are illustrated as being vertically aligned with each other in FIG. 25, the linear transporter 850 and the linear transporter 860 are practically moved in parallel so as to pass each other.

When a semiconductor wafer is loaded on the top ring 20, the push stage 810 lifts the wafer tray 870 having a semiconductor wafer W placed thereon to deliver the semiconductor wafer W to the top ring 20. Then, the semiconductor wafer W is held on the top ring 20. When a semiconductor wafer is unloaded from the top ring 20, the push stage 810 lifts the wafer tray 880 to receive a semiconductor wafer W released from the top ring 20. Thus, the semiconductor wafer W is placed on the wafer tray 880. The pusher 800 is disposed near the polishing table 12 (see FIG. 14). When a semiconductor wafer is received or delivered by the pusher 800, the support shaft 14 is rotated so that the top ring 20 is located above the pusher 800.

Figure 27:
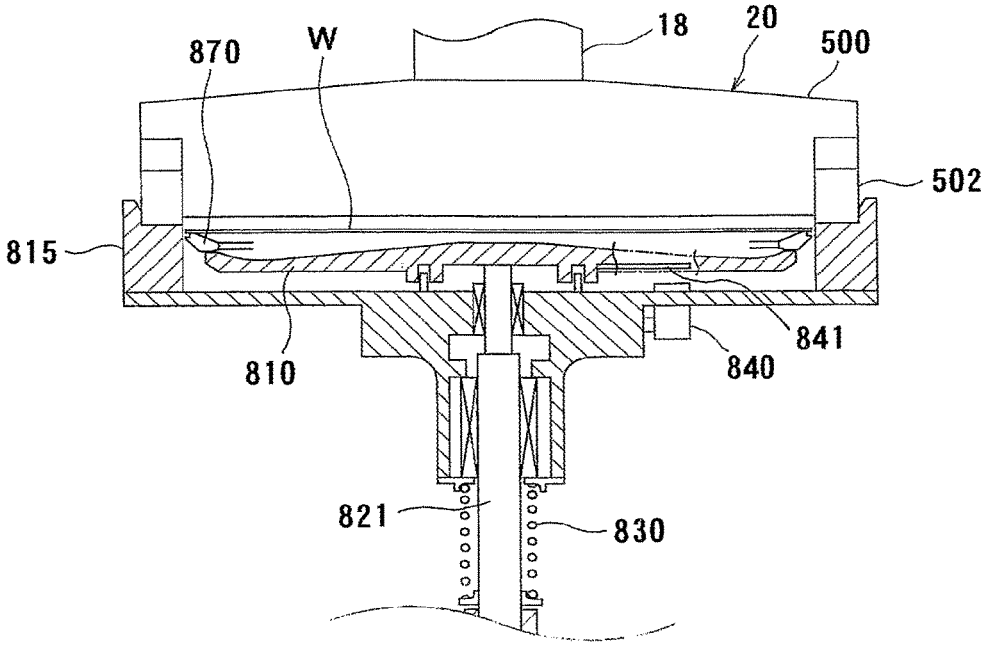
Figure 28:
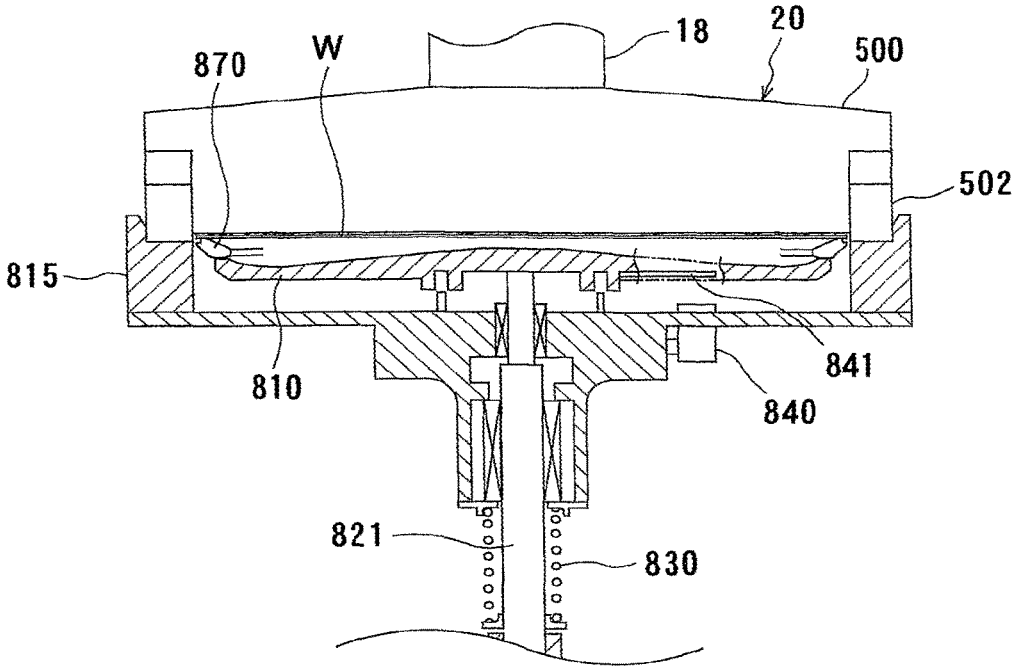

Operation of the pusher 800 will be described with reference to FIGS. 25 through 29. First, as shown FIG. 26, the linear transporter 850 is moved so that the wafer tray 870, which has a semiconductor wafer W to be polished, is located above the pusher 800. Then, as shown in FIG. 27, the second air cylinder 819 is operated to lift the first air cylinder 818, the push stage 810, and the retainer ring guide 815 so that the retainer ring guide 815 is brought into contact with the lower surface of the ring member 708. Further, as shown in FIG. 28, the first air cylinder 818 is operated to lift the push stage 810. Thus, the wafer tray 870 is lifted together with the semiconductor wafer W. Then, the semiconductor wafer W is held on (or attracted to) the top ring 20. Thereafter, the top ring 20 is moved to a position above the polishing table 12. Thus, the semiconductor wafer W is polished on the polishing table 12.

Figure 29:
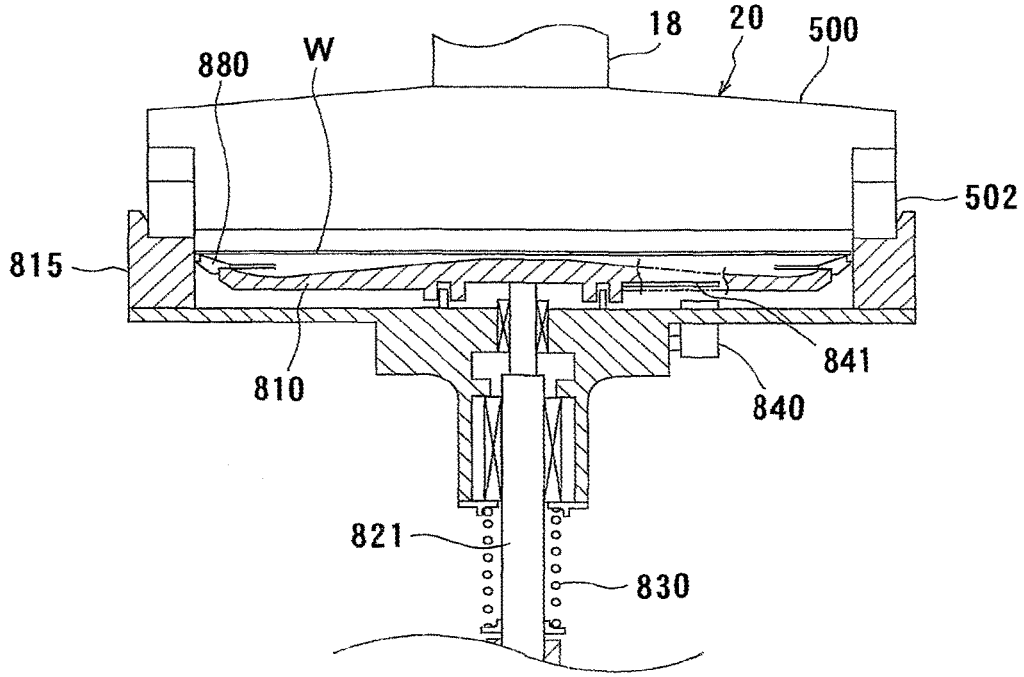

After completion of the polishing process, the support shaft 14 is rotated to move the top ring 20 to a position above the pusher 800. At that time, the linear transporter 860 is moved so that the wafer tray 880 is located above the pusher 800. Then, the second air cylinder 819 is operated to lift the first air cylinder 818, the push stage 810, and the retainer ring guide 815 so that the retainer ring guide 815 is brought into contact with the lower surface of the ring member 708. At that time, as shown in FIG. 29, a polished semiconductor wafer W is released from the top ring 20 and placed on the wafer tray 880. The second air cylinder 819 is operated to lower the push stage 810 and the retainer ring guide 815. Then, the linear transporter 860 is moved to deliver the semiconductor wafer W to a transfer robot (not shown).

When the retainer ring guide 815 is brought into contact with the lower surface of the ring member 708 (see FIGS. 27 and 29), the position of the retainer ring guide 815, which is supported by the spring 830, is varied according to the amount of wear of the ring member 708. Since the push stage 810 is fixed to the first vertical shaft 821, the position of the push stage 810 is continuously fixed. The controller 47 is operable to compare a distance between the retainer ring guide 815 and the push stage 810, which is measured by the eddy-current sensor 840, with a reference value (initial distance) to calculate the amount of wear of the ring member 708 (the retainer ring 502). The amount of wear of the ring member 708 (the retainer ring 502) may be calculated from a variation of measured values of the eddy-current sensor 840 (movement distance of the push stage 810) when the push stage 810 is lifted in a state such that the retainer ring guide 815 is brought into contact with the retainer ring 502. Specifically, data representing interrelationship between variations of measured values of the eddy-current sensor 840 and the amount of wear of the ring member 708 may be stored in a storage device of the controller 47 and used to calculate the amount of wear of the ring member 708 based on a variation of measured values of the eddy-current sensor 840.

In a conventional polishing apparatus, an eddy-current sensor is embedded in a polishing table, and a metal target is embedded in a retainer ring. The position of the target is detected by the eddy-current sensor to measure the amount of wear of the retainer ring. In this case, however, since a polishing pad is located between the eddy-current sensor and the target, it is necessary to consider the amount of wear of the polishing pad. Accordingly, it is difficult to accurately measure the amount of wear of the retainer ring. In the above example, the eddy-current sensor 840 can perform measurement without influences from the polishing pad or other components. Accordingly, the amount of wear of the ring member 708 can accurately be measured.

The amount of wear of the ring member 708 is measured when a semiconductor wafer is loaded or unloaded. When the total amount of wear of the ring member 708 reaches a predetermined value, the controller 47 issues a signal to indicate that the ring member 708 should be replaced. The amount of wear for a polishing process or sets of polishing processes is recorded in the storage device of the controller 47 so that variation of the amount of wear can be monitored by the controller 47. If the amount of wear for a polishing process or sets of polishing processes exceeds a predetermined threshold value, then the controller 47 determines that the polishing process is not normally performed. This operation will be described below.

The amount of wear of the ring member 708 depends on various factors including a pressing force applied to the ring member 708 (a pressure in the pressure chamber 710), concentrations of principal components contained in a polishing liquid, a concentration of abrasive particles in the polishing liquid, and a flow rate of the polishing liquid. The amount of wear of the ring member 708 (retainer ring 502) for a polishing process is substantially constant unless these factors are changed. Accordingly, when the amount of wear of the ring member 708 for a polishing process exceeds a predetermined threshold value, it can be seen that the polishing process has not been performed normally. In this case, for example, when a pressure in the pressure chamber 710 and a flow rate of a polishing liquid are maintained at predetermined values, it can be presumed that the components of the polishing liquid or the concentration of the abrasive particles is incorrect. Thus, with use of a plurality of sensors, it is possible to specify causes of an abnormal polishing process.

Further, correlations between the amount of wear of the ring member 708 and a polishing profile of a semiconductor wafer may be stored as polishing characteristic data (correlation data) in the storage device of the controller 47. Pressing forces of the ring member 708 can be controlled during polishing based on the correlation data by the controller 47. For example, in a case where the amount of wear of the ring member 708 for a polishing process is reduced, even if the ring member 708 is pressed against the polishing pad 22 under the same pressing force as ever, a sufficient pressure is not applied to the polishing pad 22 because the total amount of wear of the ring member 708 is increased. In such a case, it is desirable that the controller 47 corrects the pressing force of the ring member 708 based on the correlation data so as to prolong a lifetime of the ring member 708.

Further, a polishing simulation may be performed before a polishing process is started. In this case, a suitable polishing profile can be obtained by adjusting a pressing force of the ring member 708 and inner pressures of the central chamber 660, the ripple chamber 661, the outer chamber 662, and the edge chamber 663 based on data of results of the simulation and a desired polishing profile.

Instead of the amount of wear of the ring member 708, variation of wear of the polishing pad 22 may be monitored to determine whether a polishing process is performed normally. Specifically, the amount of wear of the polishing pad 22 for a polishing process is substantially constant unless polishing conditions such as a flow rate of the polishing liquid are changed. Accordingly, variation of the polishing conditions may be detected by monitoring variation of the amount of wear of the polishing pad 22. In this case, when the amount of wear of the polishing pad 22 for a polishing process or sets of polishing processes exceeds a predetermined threshold value (e.g., a predetermined first threshold value), it is determined that the polishing process has not been performed normally. Further, recipes such as polishing conditions including a rotational speed of the top ring 20 and a pressing force of the ring member 708 may previously be prepared according to the amount of wear of the ring member 708. The recipes may be changed in response to a signal from the controller 47. In such a case, it is possible to prolong a lifetime of the ring member 708.

The dresser 50 shown in FIG. 14 brings needle diamond particles, which are attached to the lower surface of the dresser 50, into sliding contact with the polishing pad 22 to remove a portion of the polishing surface 22*a*. Accordingly, the diamond particles are gradually worn out. If the diamond particles are worn out to a certain extent, desirable surface roughness of the polishing surface 22*a* cannot be obtained. As a result, the amount of abrasive particles held on the polishing surface 22*a* is reduced, so that a polishing process cannot be performed normally. In the present embodiment, the amount of wear of diamond particles is measured by the following method.

The amount of polishing pad 22 removed per unit time by the dresser 50, which is hereinafter referred to as a cut rate, depends on a pressing force under which the dresser 50 is pressed against the polishing surface 22*a* and shapes of diamond particles. Accordingly, a cut rate is reduced as the diamond particles are worn out under conditions in which the dresser 50 is pressed under a constant pressing force. In the present embodiment, a cut rate (i.e., a displacement of the polishing surface 22*a* per unit time) is measured by the aforementioned displacement sensor 60.

In the controller 47, a cut rate, i.e., a displacement of the polishing surface 22*a* per unit time (the amount of wear of the polishing pad 22) is calculated based on an output signal (measured value) from the displacement sensor 60. Data representing correlation between a cut rate and the amount of wear of the dresser 50 (i.e., diamond particles) is previously inputted into the controller 47. Then, the controller 47 calculates the amount of wear of the dresser 50 from the data. When the total amount of wear of the dresser 50 reaches a predetermined value, the controller 47 issues a signal to indicate that the dresser 50 should be replaced. Thus, the displacement sensor 60 also serves as a dresser wear detector to detect wear of the dresser 50.

As described above, when the diamond particles are worn out, the amount of abrasive particles held on the polishing surface 22*a* is reduced. Accordingly, it is presumed that the amount of wear (removal) of the retainer ring 502 (ring member 708) for a polishing process is also reduced. If the amount of wear of the retainer ring 502 for a polishing process or sets of polishing processes is lower than a predetermined threshold value (e.g., a predetermined second threshold value), the controller 47 can determine that the polishing process is not normally performed.

An operational recipe of the dresser 50 (dressing conditions such as a dressing time, a rotational speed of the dresser 50, and a pressing force to press the dresser 50 against the polishing pad 22) may be changed by the controller 47 according to the amount of wear of the dresser 50.

As described above, a time-varied amount of wear is detected while the amount of wear of worn-out components such as the ring member 708, the polishing pad 22, and the dresser 50 is detected. Accordingly, the following effects can be achieved.

1) A lifetime of respective worn-out components can be detected and prolonged. Timing of replacement of the worn-out components can be detected and predicted.

2) Polishing conditions including pressing conditions of the worn-out components, internal pressures of the pressure chambers in the top ring, conditions of the polishing liquid (temperature, pH, and the like), a rotational speed of the top ring, a rotational speed of the polishing table, and a relative speed between the substrate and the polishing pad can suitably be controlled by accumulated correlation data representing correlation between the amount of wear of the worn-out components and a polishing profile.

3) Anomaly of a polishing process can be detected.

Figure 30:
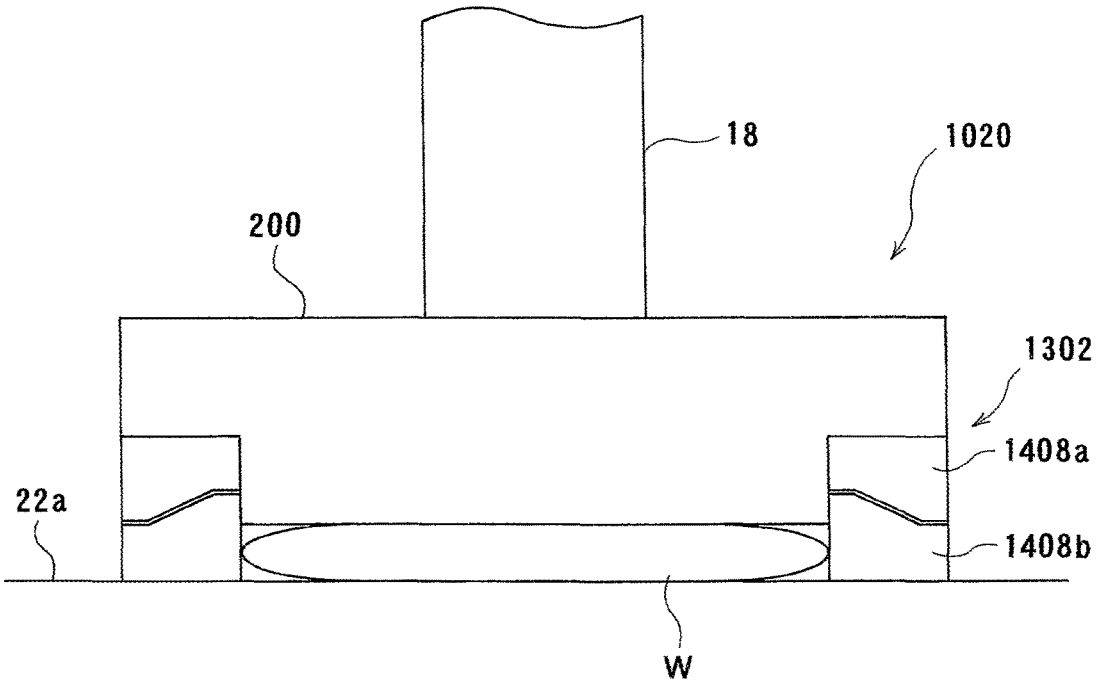
FIG. 30 is a schematic view showing a top ring in a polishing apparatus according to a sixth embodiment of the present invention.
Figure 31:
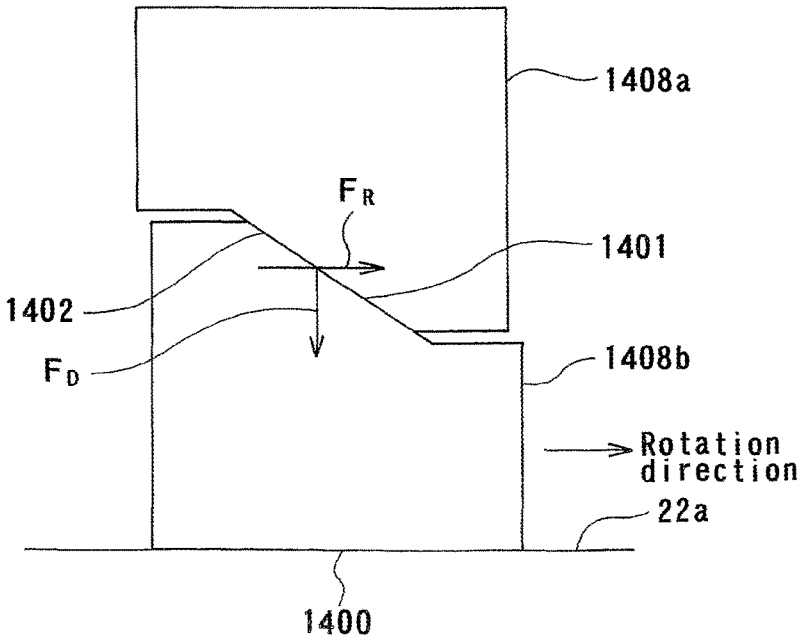
FIG. 31 is an enlarged view of a retainer ring in the top ring shown in FIG. 30.

FIG. 30 is a schematic view showing a top ring 1020 in a polishing apparatus according to a sixth embodiment of the present invention. As shown in FIG. 30, the top ring 1020 has a retainer ring 1302 including an upper ring member 1408*a* and a lower ring member 1408*b*. FIG. 31 is an enlarged view of the upper ring member 1408*a* and the lower ring member 1408*b*. As shown in FIG. 31, the lower ring member 1408*b* has a lower surface 1400 which is brought into contact with the polishing surface 22*a* and an upper tapered surface 1401. The upper ring member 1408*a* has a lower tapered surface 1402 which is brought into contact with the upper tapered surface 1401 of the lower ring member 1408*b*.

The retainer ring 1302, which is vertically movable, is configured to be slightly movable in a radial direction of the retainer ring 1302. Frictional forces produced between the retainer ring 1302 and the polishing surface 22*a* and radial forces to hold the substrate W are applied to the retainer ring 1302 during polishing. Accordingly, the retainer ring 1302 is eccentrically located downstream in a rotation direction of the polishing table 22 during polishing. In the present embodiment, as shown in FIGS. 30 and 31, the upper ring member 1408*a* and the lower ring member 1408*b* are brought into contact with each other on the tapered surfaces 1402 and 1401 to convert a radial force $F_R$ applied to the retainer ring 1302 into a downward force $F_D$.

Thus, in the present embodiment, the upper ring member 1408*a* having the tapered surface 1402 and the lower ring member 1408*b* having the tapered surface 1401 serve as a pressure control mechanism for producing a non-uniform pressure distribution along a circumferential direction of the retainer ring 1302. Particularly, pressing forces under which the retainer ring 1302 presses the polishing pad 22 are controlled so that portions located downstream in the rotation direction of the polishing table 12 are pressed under pressures higher than portions located upstream in the rotation direction of the polishing table 12. A roller may be provided between the tapered surface 1401 and the tapered surface 1402 to smoothly produce a downward force.

Figure 32:
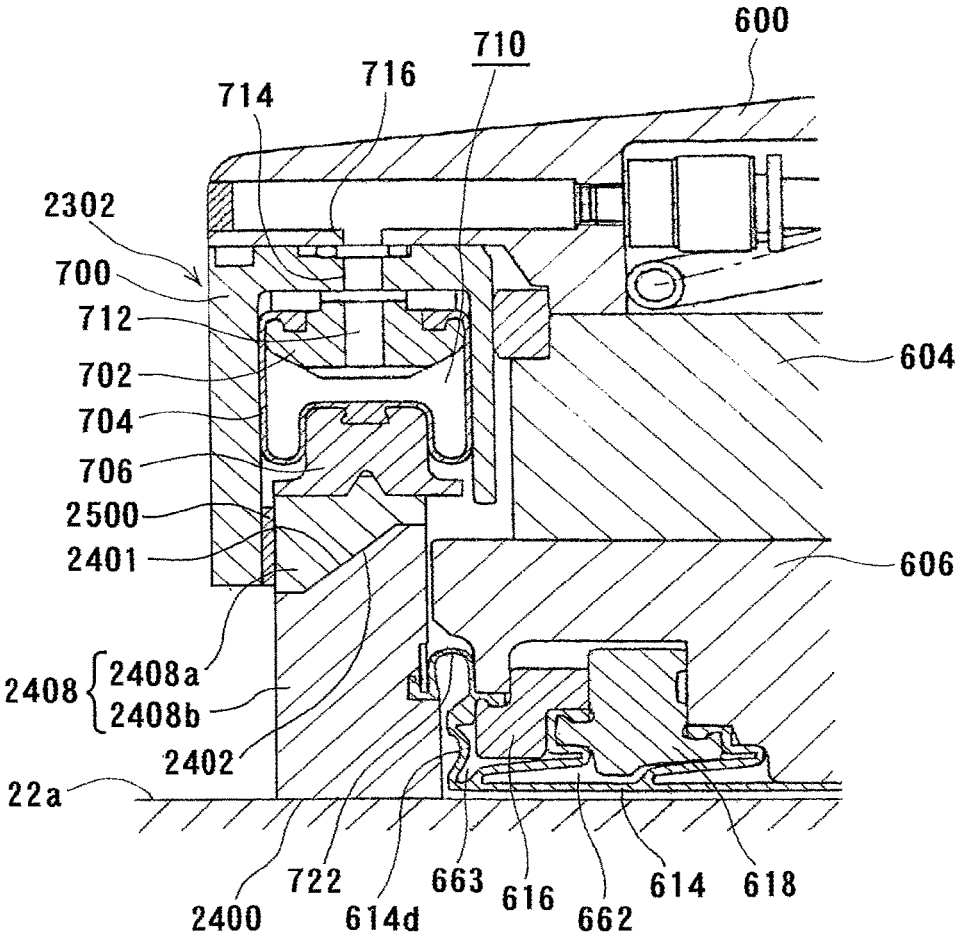
FIG. 32 is a partial enlarged view showing a top ring in a polishing apparatus according to a seventh embodiment of the present invention.

FIG. 32 is a partial enlarged view showing a top ring in a polishing apparatus according to a seventh embodiment of the present invention. As shown in FIG. 32, the top ring has a retainer ring 2302 into which the retainer ring 502 shown in FIG. 15 and the retainer ring 1302 in the sixth embodiment are combined. Specifically, the retainer ring 2302 has a ring member 2408 divided into an upper ring member 2408*a* which is brought into contact with the piston 706 and a lower ring member 2408*b* which is brought into contact with the polishing surface 22*a*. The lower ring member 2408*b* has a lower surface which is brought into contact with the polishing surface 22*a* and an upper tapered surface 2401. The upper ring member 2408*a* has a lower tapered surface 2402 which is brought into contact with the tapered surface 2401 of the lower ring member 2408*b*. The retainer ring 1302 has a plurality of pressure chambers 710 divided along a circumferential direction of the retainer ring 1302.

In the present embodiment, since a pressure control mechanism is formed by the upper ring member 2408*a* and the lower ring member 2408*b* of the retainer ring 2302, it is not necessary to provide a plurality of pressure chambers 710. Nevertheless, a plurality of pressure chambers 710 may be provided in the retainer ring 2302.

Since the pressure chambers 710 are located above the upper ring member 2408*a*, the pressure chambers 710 absorb downward forces produced by contact of the tapered surfaces 2402 and 2401 unless vertical movement of the upper ring member 2408*a* is restricted. In such a case, forces larger than those applied by the pressure chambers 710 are not applied to the ring member 2408. Accordingly, in the present embodiment, a restriction member 2800 is provided on an inner circumferential surface of the cylinder 700. The restriction member 2800 is brought into contact with the upper ring member 2408*a* to restrict vertical movement of the upper ring member 2408*a*. For example, the restriction member 2800 may be made of rubber having a large coefficient of friction.

With such a restriction member 2800, it is possible to prevent the upper ring member 2408*a* from being lifted downstream in the rotation direction of the polishing table 22. Accordingly, forces produced by contact of the tapered surfaces 2402 and 2401 can be increased so as to be larger than forces produced by the pressure chambers 710. Thus, pressing forces of the retainer ring 2302 can positively be increased at positions downstream in the rotation direction of the polishing table 22. As with the sixth embodiment, a roller may be provided between the tapered surface 2401 and the tapered surface 2402.

Although certain preferred embodiments of the present invention have been shown and described in detail, it should be understood that various changes and modifications may be made therein without departing from the scope of the appended claims.

INDUSTRIAL APPLICABILITY

The present invention is suitable for use in a polishing apparatus for polishing a substrate such as a semiconductor wafer to a flat mirror finish.

The invention claimed is:

1. An apparatus for polishing a substrate by pressing the substrate against a polishing surface, the apparatus comprising:

a top ring configured to press the substrate, a retainer ring arranged at peripheral portion of the top ring, and configured to be brought into contact with the polishing surface when polishing the substrate, a stage on which the substrate to be received or delivered is placed, a mechanism configured to move the stage toward the top ring for receiving or delivering the substrate, and a measuring unit configured to measure a position of the stage, wherein, when the substrate is received or delivered, the upper surface of the stage is brought into contact with the lower surface of the retainer ring, wherein the position of the stage is measured in a state such that the upper surface of the stage is brought into contact with the lower surface of the retainer ring, and wherein an amount of wear of the retainer ring is calculated by comparing the position of the stage measured with a reference value.

2. The apparatus according to claim 1, wherein the amount of wear of the retainer ring is calculated based on the distance moved or the position of the stage measured when the substrate is loaded or unloaded.

3. The apparatus according to claim 1, wherein a guide for alignment with the retainer ring is provided on the upper surface of the stage.

4. The apparatus according to claim 1, wherein an amount of wear of the retainer ring or a time-varied amount of wear of the retainer ring is detected, and a lifetime of the retainer ring is detected based on the amount of wear of the retainer ring or the time-varied amount of wear of the retainer ring.

5. The apparatus according to claim 1, wherein a time-varied amount of wear of the retainer ring is detected, and a timing of replacement of the retainer ring is predicted based on the time-varied amount of wear of the retainer ring.

6. The apparatus according to claim 1, wherein an amount of wear of the retainer ring or a time-varied amount of wear of the retainer ring is detected, and a timing of replacement of the retainer ring is detected based on the amount of wear of the retainer ring or the time-varied amount of wear of the retainer ring.

7. The apparatus according to claim 1, wherein an amount of wear of the retainer ring or a time-varied amount of wear of the retainer ring is detected, and polishing condition is controlled based on the amount of wear of the retainer ring or the time-varied amount of wear of the retainer ring.

8. The apparatus according to claim 1, wherein an amount of wear of the retainer ring or a time-varied amount of wear of the retainer ring is detected, and anomaly of a polishing process is detected based on the amount of wear of the retainer ring or the time-varied amount of wear of the retainer ring.

9. A method performed by an apparatus for polishing a substrate, the apparatus comprising: a top ring configured to press the substrate, a retainer ring arranged at peripheral portion of the top ring, and configured to be brought into contact with the polishing surface when polishing the substrate, and a stage on which the substrate to be received or delivered is placed, wherein the method comprises:

moving the stage toward the top ring for receiving or delivering the substrate to bring the upper surface of the stage into contact with the lower surface of the retainer ring, measuring a position of the stage in a state such that the upper surface of the stage is brought into contact with the lower surface of the retainer ring, and calculating an amount of wear of the retainer ring by comparing the position of the stage measured with a reference value.

10. An apparatus for polishing a substrate by pressing the substrate against a polishing surface, the apparatus comprising:

a top ring configured to press the substrate, a retainer ring arranged at peripheral portion of the top ring, and configured to be brought into contact with the polishing surface when polishing the substrate, a stage on which the substrate to be received or delivered is placed, a mechanism configured to move the stage toward the top ring for receiving or delivering the substrate, and a measuring unit configured to measure a distance moved of the stage, wherein, when the substrate is received or delivered, the upper surface of the stage is brought into contact with the lower surface of the retainer ring, wherein the distance moved of the stage is measured until the upper surface of the stage is brought into contact with the lower surface of the retainer ring, and wherein an amount of wear of the retainer ring is calculated from the distance moved of the stage measured by referring data stored in the apparatus, the data representing interrelationship between the distance moved of the stage and the amount of wear of the retainer ring.

11. The apparatus according to claim 10, wherein the amount of wear of the retainer ring is calculated based on the distance moved or the position of the stage measured when the substrate is loaded or unloaded.

12. The apparatus according to claim 10, wherein a guide for alignment with the retainer ring is provided on the upper surface of the stage.

13. The apparatus according to claim 10, wherein an amount of wear of the retainer ring or a time-varied amount of wear of the retainer ring is detected, and a lifetime of the retainer ring is detected based on the amount of wear of the retainer ring or the time-varied amount of wear of the retainer ring.

14. The apparatus according to claim 10, wherein a time-varied amount of wear of the retainer ring is detected, and a timing of replacement of the retainer ring is predicted based on the time-varied amount of wear of the retainer ring.

15. The apparatus according to claim 10, wherein an amount of wear of the retainer ring or a time-varied amount of wear of the retainer ring is detected, and a timing of replacement of the retainer ring is detected based on the amount of wear of the retainer ring or the time-varied amount of wear of the retainer ring.

16. The apparatus according to claim 10, wherein an amount of wear of the retainer ring or a time-varied amount of wear of the retainer ring is detected, and polishing condition is controlled based on the amount of wear of the retainer ring or the time-varied amount of wear of the retainer ring.

17. The apparatus according to claim 10, wherein an amount of wear of the retainer ring or a time-varied amount of wear of the retainer ring is detected, and anomaly of a polishing process is detected based on the amount of wear of the retainer ring or the time-varied amount of wear of the retainer ring.

18. A method performed by an apparatus for polishing a substrate, the apparatus comprising: a top ring configured to press the substrate, a retainer ring arranged at peripheral portion of the top ring, and configured to be brought into contact with the polishing surface when polishing the substrate, and a stage on which the substrate to be received or delivered is placed, wherein the method comprises:

moving the stage toward the top ring for receiving or delivering the substrate to bring the upper surface of the stage into contact with the lower surface of the retainer ring, measuring the distance moved of the stage until the upper surface of the stage is brought into contact with the lower surface of the retainer ring, and calculating an amount of wear of the retainer ring from the distance moved of the stage measured by referring data stored in the apparatus, the data representing interrelationship between the distance moved of the stage and the amount of wear of the retainer ring.

* * * * *